US009345368B2

(12) United States Patent
Formon et al.

(10) Patent No.: US 9,345,368 B2
(45) Date of Patent: May 24, 2016

(54) PAPER PRODUCT DISPENSER AND RELATED METHODS

(71) Applicant: SCA Hygiene Products AB, Göteborg (SE)

(72) Inventors: John Stephen Formon, Oxford, PA (US); Edward Arthur Raleigh, Lodi, WI (US); Jeffrey Jay Brickl, Lodi, WI (US); Matthew Tarrence Woerpel, Lodi, WI (US)

(73) Assignee: SCA HYGIENE PRODUCTS AB, Gothenburg (SE)

( * ) Notice: Subject to any disclaimer, the term of this patent is extended or adjusted under 35 U.S.C. 154(b) by 0 days.

(21) Appl. No.: 14/281,308

(22) Filed: May 19, 2014

(65) Prior Publication Data

US 2015/0327736 A1 Nov. 19, 2015

(51) Int. Cl.
*A47K 10/44* (2006.01)
*A47K 10/42* (2006.01)

(52) U.S. Cl.
CPC ..... *A47K 10/424* (2013.01); *A47K 10/44* (2013.01)

(58) Field of Classification Search
CPC .... A47K 10/44; A47K 10/424; A47K 10/425
USPC ..... 221/33, 36, 37, 42, 43, 44, 169, 165, 221/166
See application file for complete search history.

(56) References Cited

U.S. PATENT DOCUMENTS 1,114,354 A 10/1914 Hildebrand
1,163,737 A 12/1915 Calvert
1,703,594 A 2/1929 Pratt
1,752,885 A 4/1930 Carroll
2,772,021 A 11/1956 Kettles
3,117,694 A * 1/1964 Gothreau ..... 221/23
3,425,685 A 2/1969 Liva
3,608,891 A 9/1971 Hannon et al.
3,777,929 A 12/1973 Hannon et al.
4,372,549 A 2/1983 Stiernspetz (Continued)

FOREIGN PATENT DOCUMENTS

WO 01-89354 A1 11/2001

OTHER PUBLICATIONS

International Search Report and Written Opinion of the International Searching Authority (Forms PCT/ISA/210 and PCT/ISA/237) issued on Jul. 2, 2015, by the International Bureau of WIPO, in corresponding International Application No. PCT/EP2015/058403. (12 pages).

*Primary Examiner* — Patrick Mackey

(74) *Attorney, Agent, or Firm* — Buchanan Ingersoll & Rooney PC

(57) ABSTRACT

An apparatus for dispensing paper product stacked along a stacking dimension includes a housing for holding the stack of paper product and having a longitudinal dimension associated with the stacking dimension. The movable ejector is located adjacent the housing and is configured to contact paper product at an end of the stack. Movement of the ejector is effective to slide paper product at the end of the stack, relative to a remainder of the stack, in a dispensing direction, to thereby dispense paper product from the housing. A first restrictor in the housing is configured to exert a force on the stack in a first restricting direction transverse to the dispensing direction, with the first restrictor being spaced from the ejector, in the longitudinal dimension, by a first distance.

30 Claims, 12 Drawing Sheets

(56) References Cited

U.S. PATENT DOCUMENTS

| | | | | |
|---|---|---|---|---|
| 4,662,536 | A | 5/1987 | Powers | |
| 5,630,581 | A * | 5/1997 | Rodesch | 271/23 |
| 6,334,544 | B1 | 1/2002 | Christensen et al. | |
| 6,457,605 | B2 | 10/2002 | Coleman | |
| 6,789,694 | B1 | 9/2004 | McCullough | |
| 7,370,860 | B2 * | 5/2008 | James et al. | 271/171 |
| 2002/0179624 | A1 * | 12/2002 | Tramontina | 221/33 |
| 2008/0113855 | A1 | 5/2008 | Gooding, Jr. | |
| 2009/0272755 | A1 | 11/2009 | Burns | |
| 2010/0114366 | A1 | 5/2010 | Case et al. | |
| 2011/0174834 | A1 * | 7/2011 | Case | A47K 10/425 221/268 |

* cited by examiner

PAPER PRODUCT DISPENSER AND RELATED METHODS

TECHNICAL FIELD

The present disclosure is generally related to dispensers and, more particularly, to dispensers of paper product and methods for dispensing such paper product.

SUMMARY

In one embodiment, an apparatus is disclosed for dispensing paper product from a stack of paper product stacked along a stacking dimension. The apparatus includes a housing for holding the stack of paper product and having a longitudinal dimension associated with the stacking dimension. A movable ejector is located adjacent the housing and is configured to contact paper product at an end of the stack. Movement of the ejector is effective to slide paper product at the end of the stack, relative to a remainder of the stack, in a dispensing direction, to thereby dispense paper product from the housing. A first restrictor in the housing is configured to exert a force on the stack in a first restricting direction transverse to the dispensing direction, with the first restrictor being spaced from the ejector, in the longitudinal dimension, by a first distance.

The first restricting direction may be generally orthogonal to the dispensing direction. The apparatus may further include a second restrictor in the housing that is configured to exert a force on the stack in a second restricting direction that is generally opposite the first restricting direction and transverse to the dispensing direction. In specific embodiments, the first restrictor includes a movable main body for making engaging contact with the stack, and a biasing element that is configured to urge the main body toward the stack. In those or other specific embodiments, the second restrictor may be non-movable. In particular embodiments, at least one of the first restrictor or the second restrictor has a force-exerting contacting surface for exerting force on the stack, and an adjacent guiding surface for guiding paper product in the stack toward the force-exerting contacting surface. The force-exerting contacting surface and the guiding surface may be contiguous. Additionally or alternatively, the guiding surface may be oriented at an angle relative to the force-exerting contacting surface.

In a specific embodiment, the first restrictor includes a movable main body for making engaging contact with the stack, and a biasing element, with the biasing element being configured to urge the movable main body toward the stack. The movable main body may be pivotally mounted to the housing at a pivoting location. The biasing element is, in specific embodiments, a torsion spring that is located at the pivoting location. The apparatus may further include a stand that is coupled to the housing and which has a surface for resting the apparatus on horizontal surface so as to define a top end and a bottom end of the housing. In those embodiments, the ejector may be located adjacent the bottom end of the housing and may be configured to at least partially support a weight of the stack when the apparatus is resting on a horizontal surface.

The ejector may include a roller, with movement of the ejector including rotation of the roller. Additionally or alternatively, the apparatus may include an actuator that is operatively coupled to the ejector, and which is configured to move the ejector for sliding paper product at the end of the stack relative to a remainder of the stack. The actuator includes, in specific embodiments, an electric motor that is operatively coupled to the ejector. The actuator may have a plurality of available cycles of the ejector, with each of the available cycles being associated with a different number of paper products to be dispensed from the stack by the apparatus. An interior of the housing may have a generally rectangular cross-section defining a width dimension and a depth dimension of that cross-section, with the dispensing direction being generally parallel to the depth dimension, and with the first restricting direction being generally parallel to the width dimension. The housing may include at least one support ledge having a ledge surface for contacting and supporting a weight of the stack, with the ledge surface being spaced from the first restrictor, in the longitudinal dimension, by a second distance that is greater than the first distance. The ejector may, additionally or alternatively, be positioned relative to the housing so as to at least partially support a weight of the stack.

In another embodiment, an apparatus is provided for dispensing paper product from a stack of paper product stacked along a stacking dimension. The apparatus includes a housing for holding the stack of paper product and which has a longitudinal dimension associated with the stacking dimension. A roller is located adjacent the housing and is configured to contact paper product at an end of the stack, and to at least partially support a weight of the stack. Rotation of the roller is effective to slide paper product at the end of the stack, relative to a remainder of the stack, in a dispensing direction, to thereby dispense paper product from the housing. A movable restrictor in the housing is configured to exert a force on the stack in a first restricting direction transverse to the dispensing direction, with the movable restrictor having a pivotable main body and a biasing element configured to urge the pivotable main body toward the stack. A non-movable restrictor in the housing is configured to exert a force on the stack in a second restricting direction that is generally opposite the first restricting direction and transverse to the dispensing direction. The movable restrictor and the non-movable restrictor are both spaced from the roller in the longitudinal dimension. The apparatus may further include an actuator that is operatively coupled to the roller, and which is configured to rotate the roller for sliding paper product, at the end of the stack, relative to a remainder of the stack.

In yet another embodiment, a method is provided for dispensing paper product from a stack of paper product, with the paper product being stacked along a stacking dimension. The method includes supporting the stack within a dispenser, and exerting forces on a portion of the stack adjacent and end of the stack, with the forces being exerted in respective first and second restricting directions. Paper product at the end of the stack is maintained free of the forces that are exerted in the first and second restricting directions, and the paper product at the end of the stack is slid, relative to a remainder of the stack, in a dispensing direction that is transverse to the first and second restricting directions.

Sliding the paper product at the end of the stack may include sliding the paper product at the end of the stack in a dispensing direction that is generally orthogonal to at least one of the first or second restricting directions. Additionally, the method may include engaging at least one of opposed first and second sides of the stack so as to guide the stack toward a location of the dispenser at which forces are exerted in the first and second restricting directions. In specific embodiments, exerting forces in the first and second restricting directions includes urging at least one movable contacting surface toward a side of the stack. Exerting forces in the first and second restricting directions may include buckling a portion of the stack. Additionally or alternatively, sliding paper product at the end of the stack may include imparting rotational motion upon paper product at the end of the stack. The method may additionally include rotating a roller by an amount of rotation that is sufficient to engage and slide at least two successive paper products at the end of the stack, relative to a remainder of the stack, to thereby dispense the at least two successive paper product from within the dispenser.

In another embodiment, an apparatus is provided for dispensing paper product from a stack of paper product stacked along a stacking dimension. The apparatus includes means for holding the stack of paper product, with the means for holding the stack of paper product having a longitudinal dimension that is associated with the stacking dimension. The apparatus also includes movable means located adjacent the means for holding the stack of paper product, with the movable means being configured to contact paper product at an end of the stack, and with movement of the movable means being effective to slide paper product at the end of the stack, relative to a remainder of the stack, in a dispensing direction, to thereby dispense paper product from the means for holding the stack of paper product. The apparatus further includes first means for exerting a force on the stack in a first restricting direction that is transverse to the dispensing direction, with the first means for exerting a force being spaced from the movable means, in the longitudinal dimension, by a first distance.

The first restricting direction may be generally orthogonal to the dispensing direction. The apparatus may also include second means for exerting a force on the stack in a second restricting direction that is generally opposite the first restricting direction and which is transverse to the dispensing direction. In specific embodiments, the first means for exerting a force includes a movable main body for making engaging contact with stack, and biasing means configured to urge the main body toward the stack, and the second means for exerting a force is non-movable. Additionally or alternatively, at least one of the first or second means for exerting a force includes adjacent guiding means for guiding paper product in the stack toward a location at which force is exerted on the stack. In specific embodiments, the at least one of the first or second means for exerting a force includes a force-exerting contacting surface, and the guiding means includes a guiding surface, with the force-exerting contacting surface being contiguous with the guiding surface. The guiding surface may be oriented at an angle relative to the force-exerting contacting surface.

Additionally or alternatively, the first means for exerting a force may include a movable body for making engaging contact with the stack, and biasing means, with the biasing means being configured to urge the movable body toward the stack. The movable body may be pivotally mounted to the means for holding the stack of paper product at a pivoting location. The biasing means may be, for example, a torsion spring that is located at the pivoting location. In specific embodiments, the apparatus also includes orientation means coupled to the means for holding the stack of paper product and configured to secure the apparatus in an upright orientation. That upright orientation defines a top end and a bottom end of the means for holding the stack of paper product, with the movable means being located adjacent the bottom end and being configured to at least partially support a weight of the stack. The movable means may include a roller, with movement of the movable means including rotation of that roller. The apparatus, in specific embodiments, further includes actuating means operatively coupled to the movable means for moving the movable means. That movement of the movable means, in turn, is effective to slide paper product at the end of the stack, relative to a remainder of the stack.

The actuating means may include an electric motor that is operatively coupled to the movable means. The actuating means may, additionally or alternatively, have a plurality of available cycles of the movable means, each associated with a different number of paper products to be dispensed from the stack by the apparatus. The interior of the means for holding the stack of paper product may have a generally rectangular cross-section defining a width dimension and a depth dimension thereof, with the dispensing direction being generally parallel to the depth dimension, and with the first restricting direction being generally parallel to the width dimension. In specific embodiments, the means for holding the stack of paper product includes supporting means for contacting and supporting a weight of the stack, with the supporting means being spaced from the first means for exerting a force, in the longitudinal dimension, by a second distance that is greater than the first distance. Additionally or alternatively, the movable means may be positioned relative to the means for holding the stack of paper product so as to at least partially support a weight of the stack.

BRIEF DESCRIPTION OF THE DRAWINGS

The objectives and features of the invention will become more readily apparent from the following detailed description taken in conjunction with the accompanying drawings in which.

DETAILED DESCRIPTION

To the extent that any meaning or definition of a term in this written document conflicts with any meaning or definition of the term in a document incorporated by reference, the meaning or definition assigned to the term in this written document shall govern. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
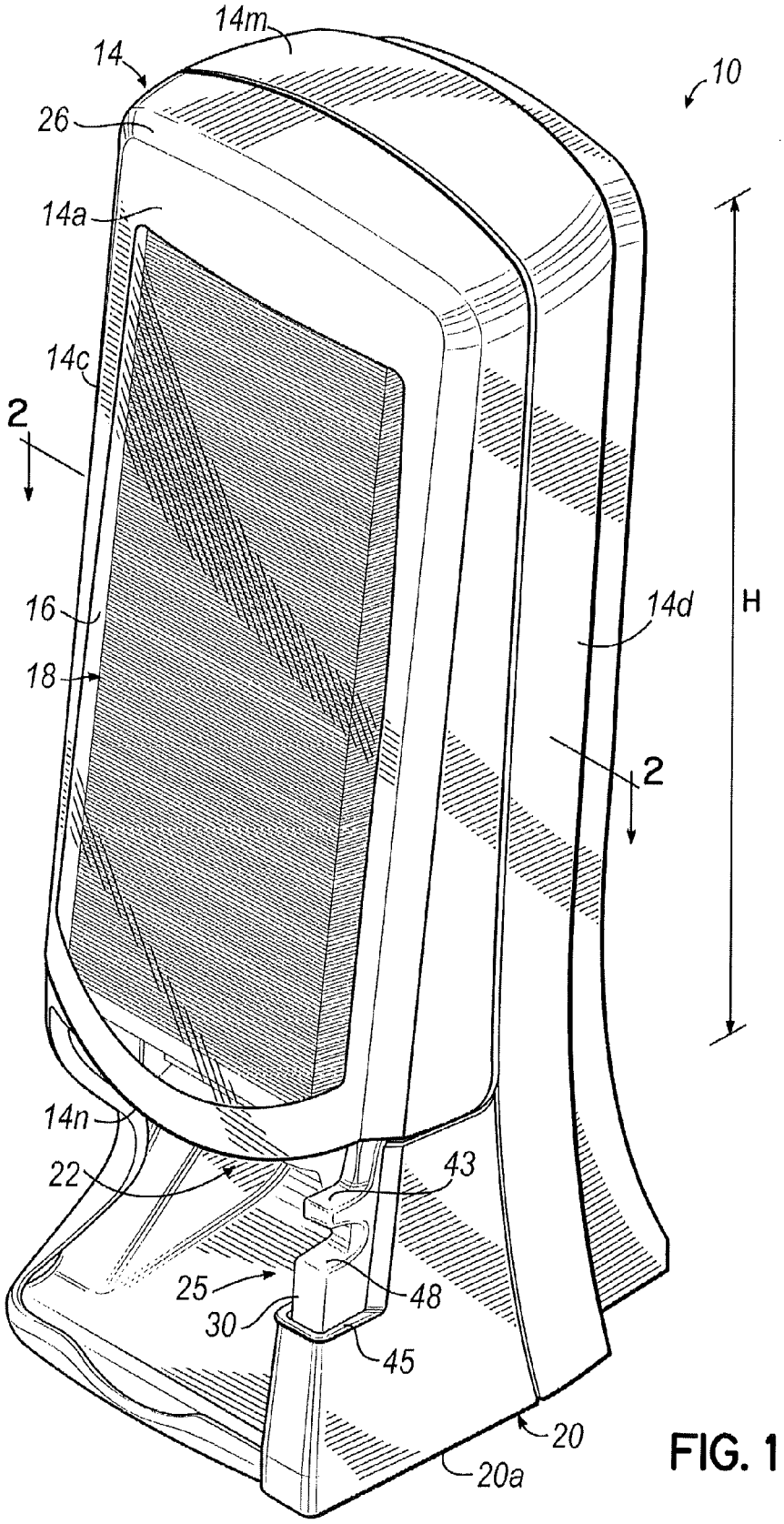
FIG. 1 is a perspective view of an apparatus for dispensing paper product in accordance with one embodiment of the invention.

With reference to the figures, and more particularly to FIG. 1, an illustrative apparatus in the form of a dispenser 10 is shown for dispensing paper product. As used herein, the term "paper product" and related terms refers to a thin substrate made of cellulose fiber paper, and also refers to other dry or moist substrates, made for example of a nonwoven material. In the exemplifying embodiment of FIG. 1, the dispenser 10 is a stand-type dispenser, configured to dispense paper product from a bottom opening of a housing of the dispenser 10, as explained more fully below. Those of ordinary skill in the art will readily appreciate, however, that the features disclosed herein are similarly applicable to other dispensers such as wall-mounted dispensers that retain the same generally upright orientation of the exemplifying dispenser 10 of FIG. 1, or other dispensers that attain a different orientation in use. For example, and without limitation, the features disclosed herein are also applicable to dispensers that are configured to rest sideways (relative to the orientation of the embodiment of FIG. 1) on a counter, table, or some other surface.

Figure 2:
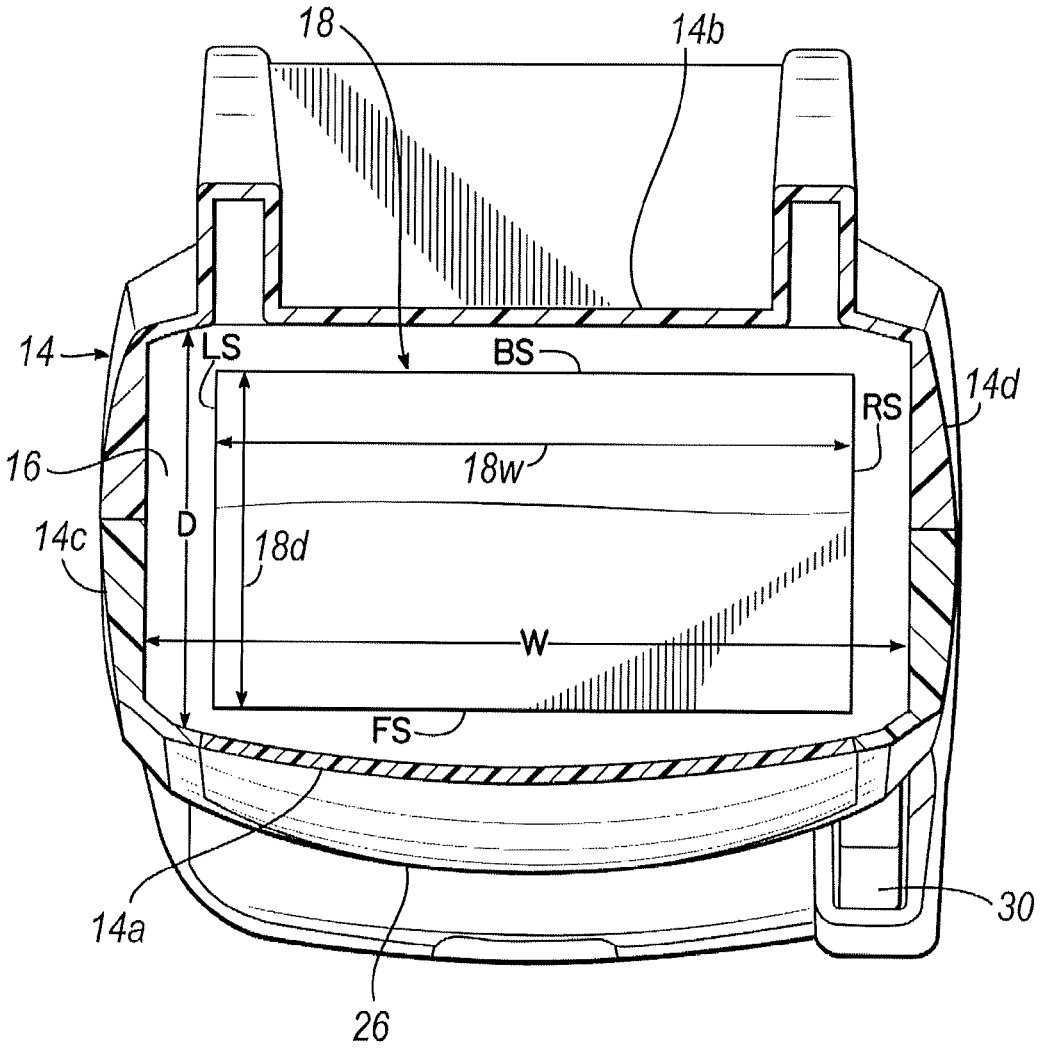
FIG. 2 is a cross-sectional view taken generally along line 2-2 of FIG. 1.
Figure 3:
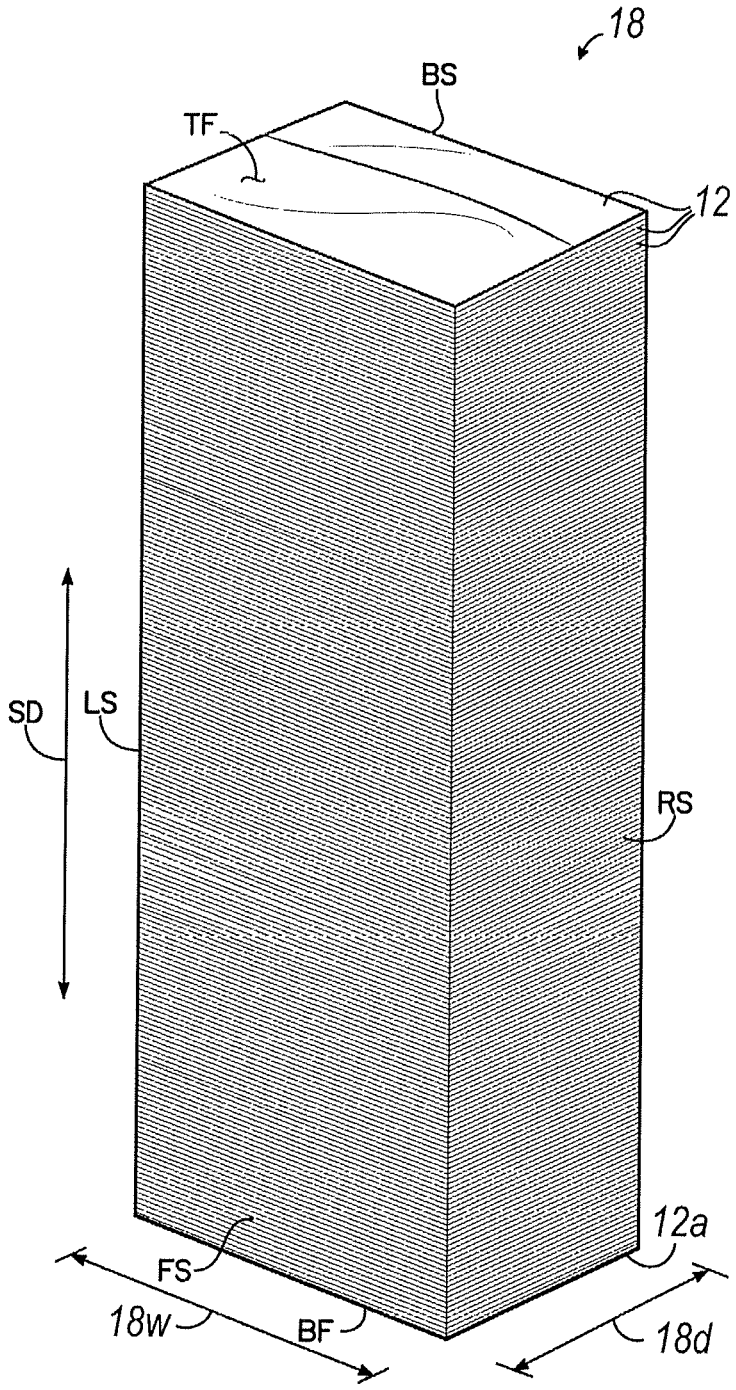
FIG. 3 is a perspective view of an illustrative stack of paper product for use with dispensers in accordance with various embodiments of the invention.
Figure 4:
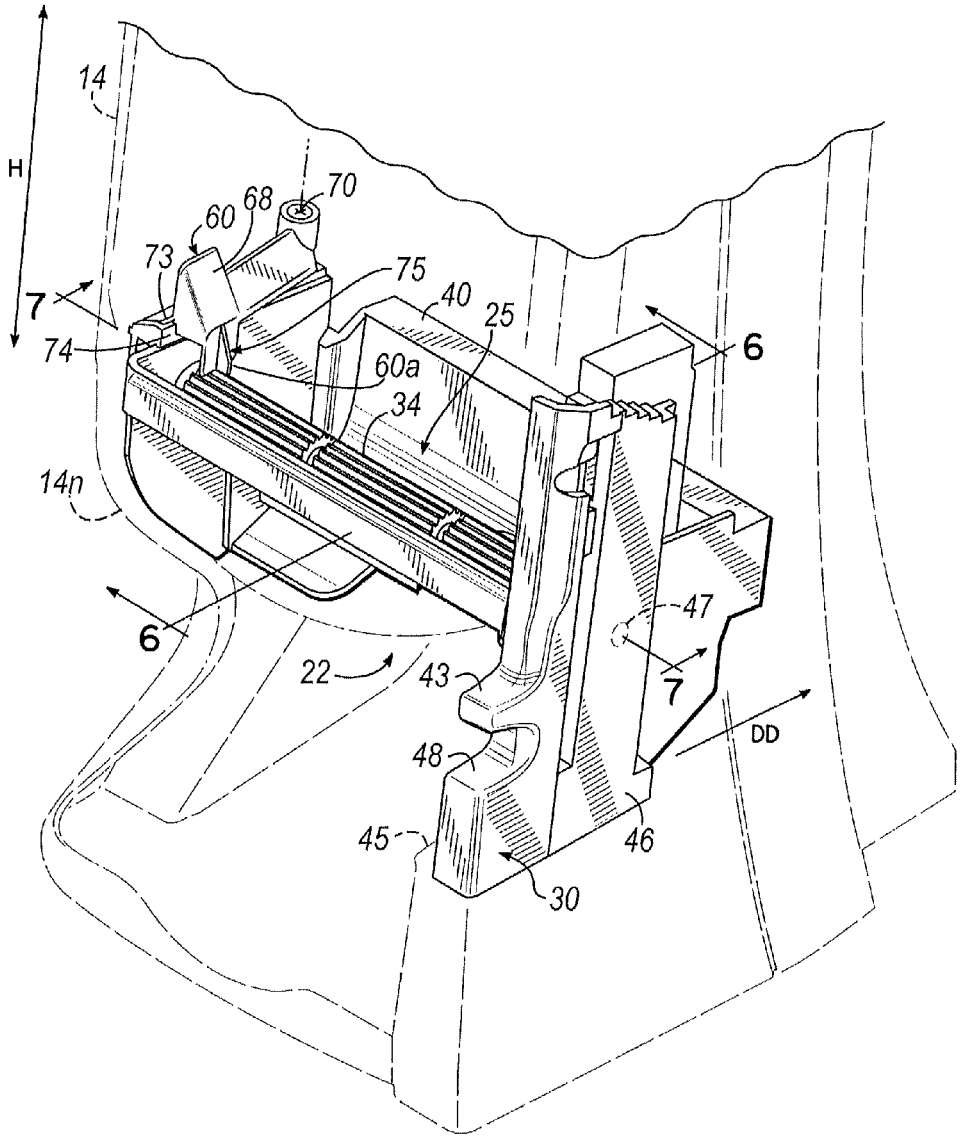
FIG. 4 is a perspective view of a portion of the dispenser of FIGS. 1 and 2.

With continued reference to FIG. 1, and further referring to FIGS. 2 and 3, dispenser 10 is configured to dispense paper product provided in stack form. To that end, dispenser 10 includes a housing 14 that is configured to support, in the interior 16 of the housing 14, paper product stacked generally along a stacking dimension SD, to thereby define a stack 18 of paper product (FIG. 3). One suitable form of a stack 18 of paper product that can be used with dispenser 10 includes a plurality of quarter-folded, interfolded (i.e., interleaved) paper napkins 12, such as those disclosed in U.S. Pat. No. 8,399,087, assigned on its face to SCA Tissue North America LLC; U.S. Pat. No. 8,609,223, assigned on its face to SCA Hygiene Products AB; or U.S. Pat. No. 8,597,761, also assigned on its face to SCA Hygiene Products AB. The exemplifying stack 18 shown in FIG. 3 has a generally rectangular cross-section, defining opposed front and back sides FS, BS of the stack 18, as well as laterally opposed left and right sides LS, RS of the stack 18, with the "front," "back," "left," and "right" designations not intended to be limiting but rather referring to the illustrative orientation shown in FIGS. 1-3.

The exemplifying stack 18 also has a top face TF, defined by the topmost of the napkins 12 in the stack 18, as well as a longitudinally opposed bottom face BF, defined by the bottommost napkin 12*a* in the stack 18. It is likewise understood that the terms "top," "bottom," and derivatives thereof are not intended to be limiting but rather refer to the illustrative orientation of the stack 18 shown in FIG. 3. Further, the interior 16 in the embodiment of FIGS. 1 and 2 has a longitudinal or height dimension H that generally corresponds (e.g., it is generally parallel) to the stacking dimension SD of stack 1, and has a cross-sectional shape that more or less conforms to the cross-sectional shape of the stack 18. More specifically, as shown in FIG. 2, the interior 16 of housing 14 has a generally rectangular cross-section, similar to the cross-sectional shape of stack 18, thereby defining a width dimension W and an orthogonal depth dimension D of that interior 16. The resemblance between the cross-sectional shapes of the interior 16 and the stack 18 facilitates the support of stack 18 by a front wall 14*a*, opposed back wall 14*b*, and left and right sidewalls 14*c*, 14*d* of housing 14, which may be desirable particularly for stacks 18 formed with low levels of compression or that otherwise lack stability. As used herein, the terms "front," "back," "left," and "right" when used to describe walls of the housing 14 refer to the illustrative—rather than limiting—generally upright orientation of dispenser 10 as seen in FIG. 1. The interior 16 of housing 14 may alternatively take other forms, conforming or not with the shape of the stack 18 supported in interior 16, with those alternative forms being considered to fall within the scope of the present disclosure.

With continued reference to FIGS. 1-3, in the embodiment illustrated in those figures, the depth dimension D of the interior 16 of housing 14 is generally parallel to the left and right sides LS, RS of stack 18 and to a depth dimension 18*d* of stack 18, while the width dimension W of interior 16 is generally parallel to the front and back sides FS, BS of stack 18 and to the width dimension 18*w* of stack 18. As used throughout this disclosure, and unless otherwise limited, the term "generally" when referring to the orientations, directions, or dimensions of two or more objects or vectors being opposite, parallel or orthogonal to one another, is intended to cover deviations of up to 10 degrees from exactly opposite, exactly parallel, or exactly orthogonal, respectively.

With continued reference to FIGS. 1-3, the housing 14 of the dispenser 10 is coupled to and supported by an optional stand 20, which has a bottom surface 20*a* configured to rest on a generally horizontal surface, so as to permit the dispenser 10 to attain the stable, generally upright orientation shown in FIG. 1. In that exemplifying but not limiting upright orientation, housing 14 has a top end 14*m*, and a longitudinally opposed bottom end 14*n*. The bottom end 14*n* has an opening 22 which, as explained more fully below, cooperates with a dispensing mechanism 25 of dispenser 10 to dispense napkins 12 from within the housing 14 to make them available for use.

The housing 14 also includes a door 26 that, in the illustrated embodiment, defines a portion of the front wall 14*a* and the sidewalls 14*c*, 14*d* of housing 14. Further in that embodiment, door 26 is hingedly mounted to the remainder of housing 14, through one or more hinges (not shown). When the door 26 is in an open position, the interior 16 of housing 14 is exposed so as to permit loading of full or partial stacks 18 of napkins 12. When door 26 in closed, access to the interior 16 is restricted, which may be desirable particularly if the dispenser 10 is used in an area with a relatively high level of dust or other contaminants, which may otherwise contaminate the napkins 12 in the stack 18 supported within housing 14. The closed position of door 26 may also be able to provide support for the stack 18. More specifically, if the dispenser 10 is used in environments subject to vibration, the closed door 26, defining front wall 14*a*, may be able to prevent the stack 18 from tipping forward.

The door 26 is made of a suitably chosen rigid material, such as a plastic material, and may further be made of a translucent material. In one contemplated example, at least a portion of the door 26 is made of a transparent plastic material, which permits the user to assess the height of the stack 18 within housing 14 to determine whether more napkins 12 need to be added to the stack 18. A transparent door 26, in another aspect, may be able to permit visualization, from the exterior of housing 14, of optional advertising material secured against the interior surface of door 26.

While the embodiment of FIGS. 1 and 2 includes a door 26, as described above, providing access to the interior 16 of housing 14, alternative embodiments are contemplated that do not include a door, but which nevertheless permit the loading of napkins 12 into the interior 16 of housing 14. For example and without limitation, embodiments are contemplated in which the top end 14*m* of housing 14 has an opening sufficiently large so as to permit the loading, through that opening, of full or partial stacks 18 of napkins 12 into the interior 16 of housing 14.

With continued reference to FIGS. 1-3, and further referring to FIGS. 4, 5, 6, 7, 8, 9, and 10, dispenser 10 includes, as noted above, a dispensing mechanism 25 that cooperates with the opening 22 at the bottom end 14*n* of housing 14 to dispense napkins 12 from the interior 16 of housing 14. The dispensing mechanism 25 includes an actuator 30 and a movable ejector that, in the exemplifying embodiment of those figures, is in the form of a roller 34 adjacent the opening 22 at the bottom end 14*n* of housing 14. The actuator 30 is operatively coupled to the roller 34 such that sliding downward movement of the actuator 30 is effective to cause the roller 34 to rotate. Rotation of the roller 34, in turn, is effective to slide one or more napkins 12 at the bottom of the stack 18, relative to the remainder of the stack 18, to thereby dispense the one or more napkins 12 from within housing 14. The sliding movement of the napkins 12 being dispensed is along a dispensing direction DD (FIGS. 4-6, 8, and 9) which, in the illustrated embodiment, is generally parallel to the depth dimension D of interior 16 of housing 14, and to the depth dimension 18*d* of stack 18 (FIG. 2). The dispensing direction DD is defined by a line (not shown) tangent to the uppermost surface of roller 34. As used herein, the term "uppermost" when referring to the surface of roller 34 is intended to refer to the illustrative orientation shown, for example, in FIGS. 4 and 5.

Figure 6:
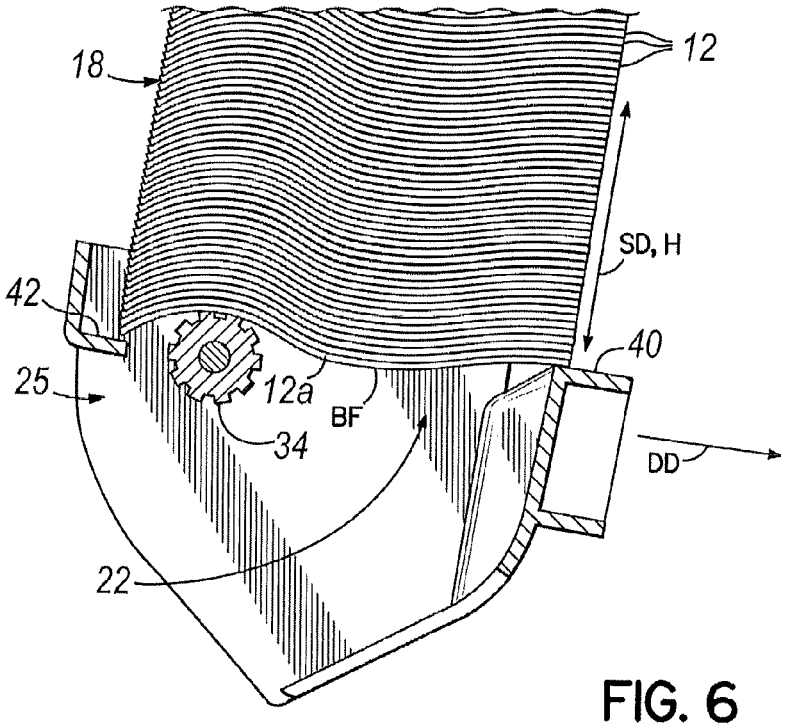
FIG. 6 is a cross-sectional view taken generally along line 6-6 of FIG. 4, further illustrating a portion of a stack of paper product to be dispensed.
Figure 7:
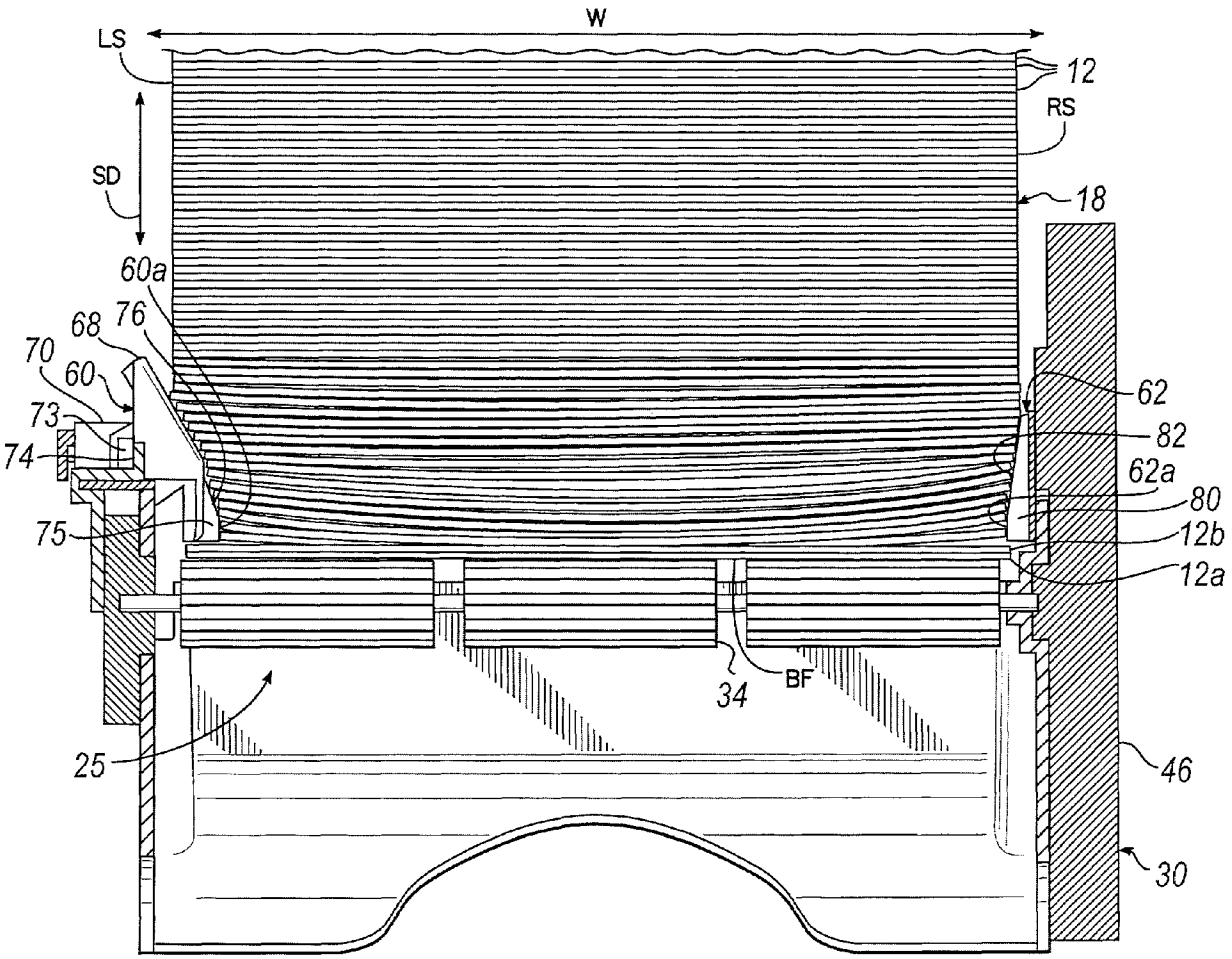
FIG. 7 is a cross-sectional view taken generally along line 7-7 of FIG. 4, further illustrating a portion of a stack of paper product to be dispensed.

Referring particularly to FIGS. 6-10, those figures illustrate an exemplifying operation of dispenser 10. FIGS. 6 and 7 illustrate the weight of stack 18 being supported by a back support ledge 40 at the bottom end 14*n* of housing 14, as well as by the roller 34, as more fully explained below. A front support ledge 42 at the bottom end 14*n* of housing 14, opposite the back support ledge 40, may also be used to partially support the weight of the stack 18, particularly for stacks 18 having a relative large depth dimension 18*d*. More specifically, in the illustrated embodiment, the back support ledge 40 engages the exposed surface of the bottommost napkin 12*a* in stack 18, at the back edge of that bottommost napkin 12*a*. Stacks 18 having a relatively large depth dimension 18*d* (FIGS. 2 and 3) would additionally be engaged by the front support ledge 42, which would also partially support the weight of the stack 18 above, by engaging the front edge of the bottommost napkin 12*a* in the stack 18. Those of ordinary skill in the art will readily appreciate that the dispenser 10 may be configured such that stack 18 is alternatively supported by features different from or in addition to the exemplifying back and front support ledges 40, 42. For example, and without limitation, a contemplated dispenser may have a rod or a plate located inboard of the back and front support ledges 40, 42 supporting either part or the entirety of the weight of stack 18.

In the embodiment of FIGS. 4-10, the roller 34 is positioned relative to the support ledges 40, 42 so as to at least partially support the weight of stack 18 above, by similarly engaging the exposed surface of the bottommost napkin 12*a*. In that embodiment also, the napkin-contacting surface of the back support ledge 40 is located higher than the napkin-contacting surface of the front support ledge 42, while the upper, napkin-contacting surface of the roller 34 is located higher than both of the napkin-contacting surfaces of the back and front support ledges 40, 42. This type of arrangement, though optional, may be effective to provide a larger area of contact between the roller 34 and the bottommost napkin 12*a* than would otherwise be available with other configurations. More specifically, as shown particularly in FIG. 6, that exemplifying arrangement results in the bottom face BF of stack 18 effectively wrapping around roller 34. The relatively large area of contact, in turn, may be effective to provide a high level of grip of napkin 12*a* by roller 34, which facilitates dispensing, particularly for napkins 12 made of smooth materials i.e., materials resulting in a low coefficient of friction against the material or materials making up roller 34.

Figure 8:
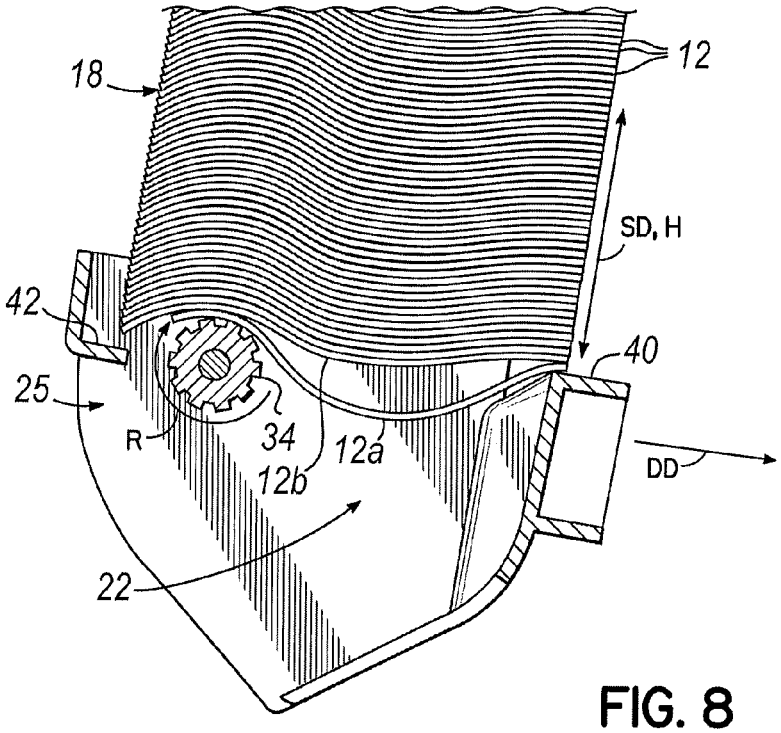
FIG. 8 is a view similar to FIG. 6, illustrating dispensing of paper product in accordance with one embodiment of the invention.
Figure 9:
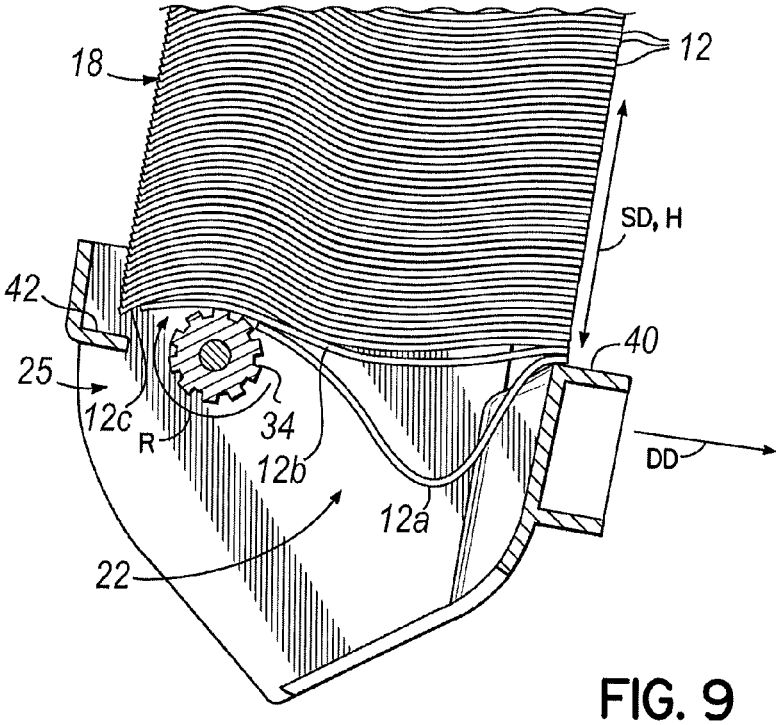
FIG. 9 is a view similar to FIGS. 6 and 8, further illustrating dispensing of paper product in accordance with one embodiment of the invention.
Figure 10:
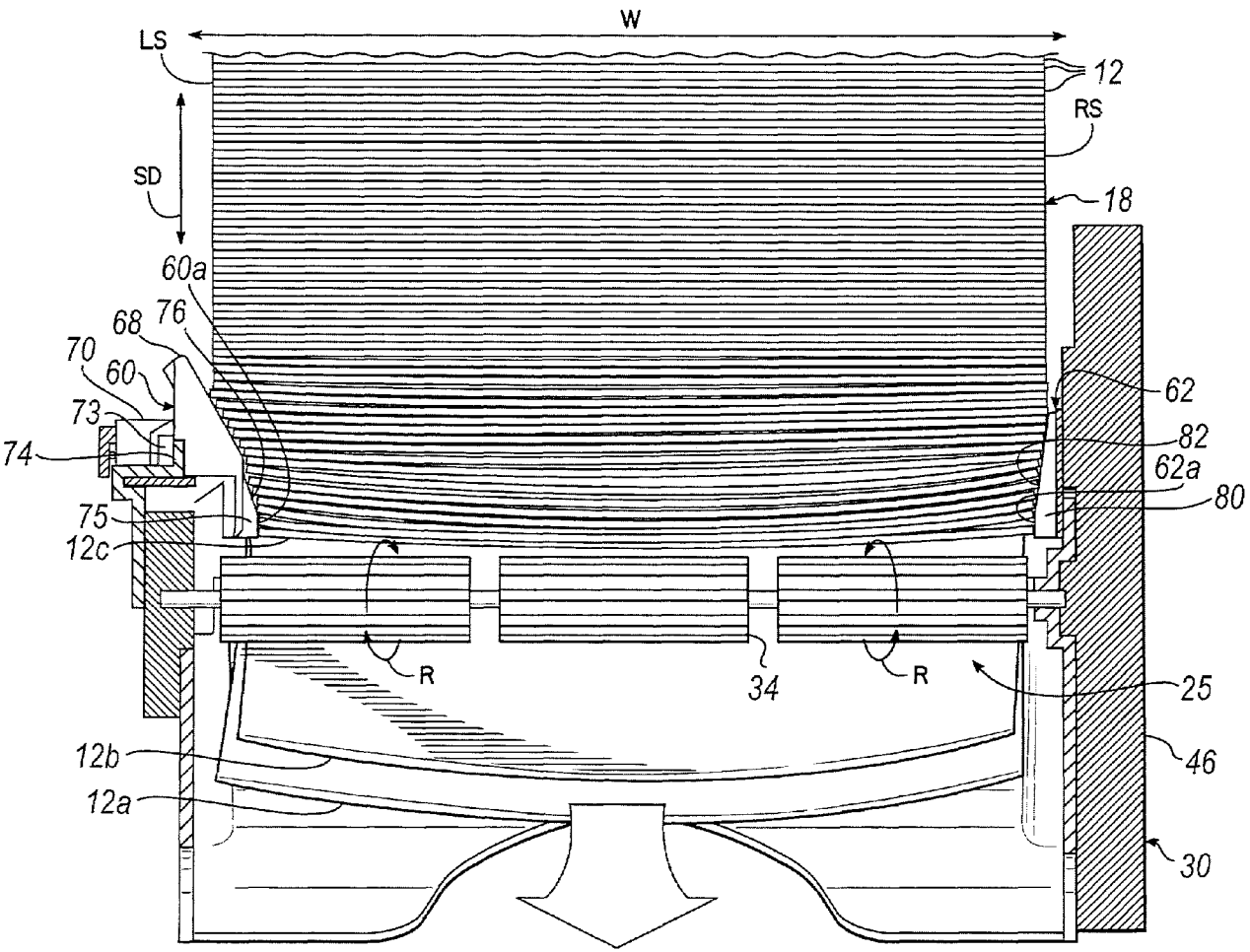
FIG. 10 is a view similar to FIG. 7, also illustrating dispensing of paper product in accordance with one embodiment of the invention.

FIG. 8 shows the roller 34 having rotated by a first amount relative to the view of FIGS. 6 and 7. The frictional grip of the exposed surface of napkin 12*a* by the surface of roller 34 is shown having imparted rotational motion to the napkin 12*a*, thereby having caused the front edge of napkin 12*a* to move generally in the dispensing direction DD. For stacks 18 being supported by the front support ledge 42, the rotational motion imparted by roller 34 on napkin 12*a* would also be effective to disengage the front edge of napkin 12*a* from the napkin-contacting surface of the front support ledge 42. FIG. 8 also shows rotation of roller 34 directing a major portion of the napkin 12*a* toward the portion of opening 22 defined between roller 34 and back support ledge 40, except for the back edge of napkin 12*a*. Turning now to FIGS. 9 and 10, roller 34 is shown having rotated by a greater amount than in FIG. 8, thereby resulting in a major portion of napkin 12*a* extending through the opening 22 and ready for retrieval by a user.

As FIG. 9 illustrates, the back edge of napkin 12*a* is pinned between the remainder of the stack 18 above and the back support ledge 40, which in effect results in the napkin 12*a* being supported in cantilever fashion by the housing 14. That figure also shows roller 34 beginning to engage the now-exposed surface of the second napkin 12*b*, above the bottommost napkin 12*a*. Further rotation of roller 34 is effective to impart rotational motion to the second napkin 12*b* in a manner similar to that described above with respect to the dispensing of bottommost napkin 12*a*, ultimately resulting in both of the successive napkins 12*a*, 12*b* being supported in cantilever fashion by housing 14, pinned between the remainder of the stack 18 above and the back support ledge 40. FIG. 10 illustrates both of the successive napkins 12*a* and 12*b* extending through the portion of opening 22 behind (in that figure) roller 34, and ready for retrieval by a user.

Yet additional rotation (arrows R) of roller 34 would be effective to engage and dispense the third successive napkin 12*c*, above napkin 12*b*, and so on. In the illustrated embodiment, in which the stack 18 is made up of interfolded napkins 12, and while not shown for purposes of clarity, the dispensing mechanism 25 dispenses napkins 12 in multiples of 2. It is understood, however, that this type of dispensing is a non-limiting example, insofar as the napkins 12 in stack 18 may instead not be interfolded, in which case dispensing mechanism 25 would dispense napkins one at a time, or more than one at a time if successive napkins are nested or otherwise attached to one another. Similarly, the stack 18 may alternatively be made up of napkins 12 that are interleaved in a manner that results in napkins 12 being dispensed in multiples of another number greater than 2, all of which would be considered to fall within the scope of the present disclosure.

With particular reference to FIGS. 4-10, the amount of rotation of roller 34, and therefore the number of napkins 12 dispensed from within housing 14, is determined by the type of cycle selected by the user when engaging the actuator 30. More specifically, the actuator 30 in the embodiment illustrated in those figures is a mechanical device having two different options for selection by the user, each corresponding to a different cycle of the roller 34 i.e., each corresponding to a different amount of rotation to be imparted onto the roller 34. A first option, for example, may correspond to an amount of rotation of roller 34 that is effective to dispense only the bottommost napkin 12*a*. Likewise, a second option may for example correspond to an amount of rotation of roller 34 that is effective to dispense two successive napkins at the bottom end of the stack 18 i.e., napkins 12*a* and 12*b*. In the embodiment shown in FIGS. 4 and 5, a first selectable option is defined by the vertical distance traveled by a user's finger engaging a first actuating surface 43 of actuator 30, when traveling downward, until the finger hits a stop surface 45 located adjacent the actuator 30. The vertical distance traveled by actuator 30, in turn, determines the amount of rotation of roller 34 through engagement of a rack (not shown) of actuator 30, located within an actuator housing 46, that is in intermeshed with a pinion 47 coupled to the roller 34.

According to an embodiment of the disclosure, an apparatus 10 is configured to dispense paper product from an end of a stack 18 of paper product 12 stacked along a stacking dimension defining a thickness of the stack, each paper product having a plurality of side edges orthogonal to the stacking dimension of the stack. The apparatus 10 includes a housing 14 for encompassing the stack 18 of paper product, the housing 14 being arranged within the apparatus 10 and having a longitudinal dimension generally parallel to the stacking dimension, and the housing is configured to support the end of the stack at an end position of the housing. The apparatus 10 further includes a movable ejector 34 located adjacent said housing 14 and having a contacting surface configured to contact the paper product at the end of the stack 18, movement of said ejector 34 being effective to slide the paper product at the end of the stack, relative to a remainder of the stack, in a dispensing direction DD, to thereby dispense paper product from said housing 14. A first restrictor 60 is provided in said housing 14 having a first force-exerting contacting surface 60*a* configured to exert a first force on a portion of the stack 18 that is spaced from the end position in a first restricting direction LD transverse to the dispensing direction DD, said first restrictor 60 being spaced from said end position in the longitudinal dimension by a first distance such that no force is exerted on the stack in the first restricting direction between the first restrictor 60 and the ejector 34. See, e.g., napkins 12*a*, 12*b* in FIG. 7. A second restrictor 62 is provided in said housing 14 having a second force-exerting contacting surface 62*a* configured to exert a second force on the same portion of the stack 18 on which the first force-exerting contacting surface 60*a* is configured to exert the first force, the second force being oriented in a second restricting direction RD that is generally opposite the first restricting direction LD and transverse to the dispensing direction DD. The second restrictor 62 is spaced from the end position such that no force is exerted on the stack 18 in the second restricting direction RD between the second restrictor 62 and the ejector 34.

A second selectable option in that illustrative embodiment is defined by the vertical distance traveled by a user's finger engaging a second actuating surface 48 of actuator 30, when traveling downward, until the finger hits the stop surface 45 located adjacent actuator 30. Irrespective of the cycle selected by the user, downward movement of the actuator 30 is followed by upward movement of actuator 30, which returns to a home position by virtue of an extension spring (not shown) that is coupled to the actuator housing 46 of actuator 30. Once the actuator housing 46 returns to the home position, the actuator 30 is once again ready for selective engagement of the actuating surfaces 43 or 48 by the user, so as to dispense additional napkins 12. Notably, in this embodiment, a clutch (not shown) coupled to the pinion 47 and actuator housing 46, prevents reverse rotation of roller 34 during upward movement of actuator housing 46 returning to the home position. This optional feature may be desirable in order to minimize the likelihood of jams in the dispensing operation of dispenser 10.

In the exemplifying embodiment of FIGS. 4-10, roller 34 extends in the width dimension W of housing 14, and spans a substantial portion of the width of opening 22. More specifically, in that embodiment, the roller 34 is made up of three segments that are configured to engage the exposed surface of the napkin 12*a* (defining the bottom face BF of stack 18), with those segments having a combined width that is at least about 85% of the total width of opening 22. A relatively large width of the roller 34 may be desirable so as to increase the amount of grip between roller 34 and the napkin 12*a* above, which may facilitate dispensing of napkins 12 made of materials having a low coefficient of friction with the material or materials making up the surface of roller 34. Alternative embodiments are contemplated in which the width of roller 34, whether integral or made up of multiple segments, makes up between about 50% and about 99% of the width of opening 22, or between about 60% and about 90% of the width of opening 22, or between about 70% and about 85% of the width of opening 22. All of those alternative embodiments, as well as the embodiment illustrated in FIGS. 4-10, are considered to have a roller 34 that spans a substantial portion of the width of opening 22, understanding that the term "substantial" as used herein refers to rollers 34 that span at least about 50% of the width of opening 22.

Figure 11:
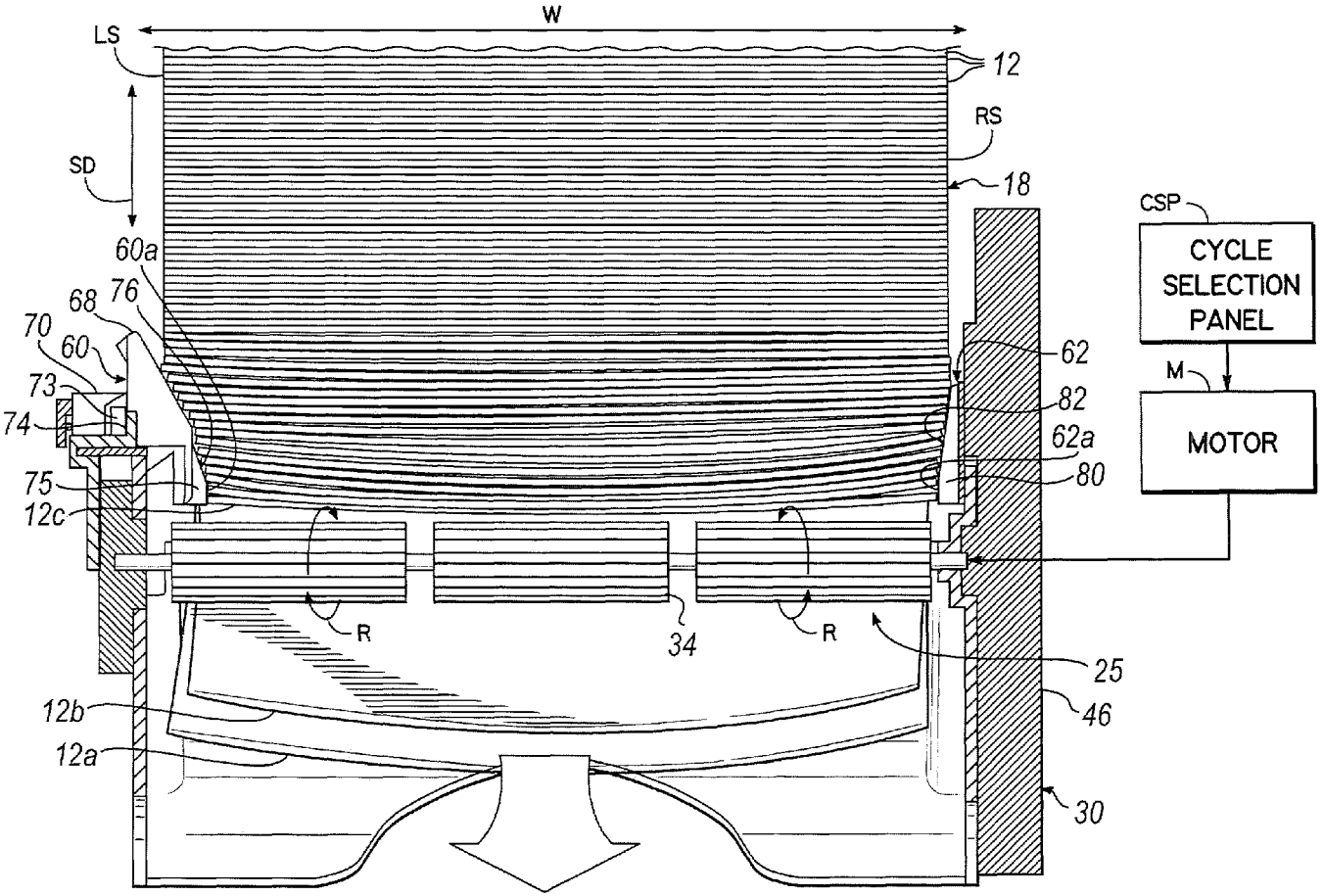
FIG. 11 is a view similar to FIGS. 7 and 10, illustrating a portion of a dispenser in accordance with another embodiment of the invention.

While the exemplifying dispenser 10 in FIGS. 4-10 includes a mechanical actuator 30 operatively coupled to the roller 34, alternative embodiments are contemplated in which the actuator 30 includes, alternatively or additionally, an electric motor and an electronic interface for selecting one of the available cycles of roller 34, and therefore the desired number of napkins 12 to be dispensed. FIG. 11 schematically illustrates one such alternative embodiment. The electronic interface could, for example, include a cycle selection panel CSP having a plurality of buttons, with each button corresponding to one of the available cycles of roller 34. Each button, in turn, would be programmed to cause a predetermined amount of rotation of motor M and thereby of roller 34, with that amount of rotation of roller 34 in turn being associated with dispensing a predetermined number of napkins 12.

In that regard, the cycle selection panel CSP may be located on the stand 20, housing 14, or any other portion of dispenser 10, or may be even be located remotely from dispenser 10. For example, and without limitation, the present disclosure contemplates a remote panel that forms part of a cash register that commands the dispenser 10 to dispense a predetermined number of napkins 12, associated or not with the amount or type of a purchase for which napkins 12 are being dispensed. Such remote panel would communicate with dispenser 10 through a network connection, a wireless connection, or any other type of remote connection with which those of ordinary skill in the art are familiar.

Likewise, dispensers are contemplated having no actuator at all. Alternative embodiments having no actuator may for example rely on the user manually rotating the roller 34 at the bottom of housing 14, with the rotation of the roller 34 being effective to dispense one or more napkins 12 in the manner explained above with respect to the embodiments of FIG. 4-10 or 11. Those of ordinary skill in the art will readily appreciate that dispensers having no actuator at all are simpler to manufacture and to maintain, than similar dispensers that do include an actuator. Those of ordinary skill in the art will similarly appreciate that dispensers having an actuator may facilitate accurate, easy to control dispensing of a desired number of napkins 12.

While in the embodiments of FIGS. 4-11 the ejector is in the form of a roller 34 as shown and described above, it is contemplated that the ejector may alternatively take other forms, including non-rotating forms. For example, and while not shown, the ejector may be a structure that moves linearly, rather than circumferentially, in the dispensing direction DD (FIGS. 4-6, 8, and 9), to thereby dispense napkins 12 in the manner discussed above. The ejector in embodiments of that type may be retractable, for example generally along the longitudinal or height dimension H of housing 14 (FIG. 4), into and away from engagement with the exposed surface of the bottommost napkin 12*a*. The ejector may even include two or more structures that move linearly. For example, linearly-moving ejectors are contemplated having first and second napkin-engaging surfaces of different dimensions. The first of those napkin-engaging surfaces would be sized so as to engage and dispense, when in motion, only the bottommost napkin 12*a* at the end of the stack 18. A second of those napkin-engaging surfaces would be sized so as to engage and dispense, when in motion, two successive napkins 12*a*, 12*b* at the end of the stack 18.

With continued particular reference to FIGS. 4-11, and now further referring to FIGS. 12, 13, 14, 15, and 16, the exemplifying embodiments shown in those figures include features to exert lateral forces on a portion of the stack 18, to ensure that the desired number of napkins 12 is dispensed through rotation of roller 34. These features are particularly desirable when the dispenser 10 is loaded with napkins 12 that have been stacked under high levels of compression, which may tend to cause napkins to nest with one another and thereby stick together. More specifically in the illustrated embodiments, dispenser 10 has a movable, first restrictor 60 adjacent the left sidewall 14*c* of housing 14, and an opposed, non-movable, second restrictor 62 adjacent the right sidewall 14*d* of housing 14. In that regard, the first and second restrictors 60, 62 are also respectively adjacent the left and right sides LS, RS of stack 18 (FIGS. 2 and 3).

The first and second restrictors 60, 62 exert frictional forces against portions of the lateral (i.e., left and right) sides LS, RS of the stack 18, so as to prevent napkins 12 in those portions from being dispensed when roller 34 rotates. FIGS. 12 and 14-16, in particular, show the first and second restrictors 60, 62 having respective force-exerting contacting surfaces 60*a*, 62*a*, that are configured to make engaging contact with the lateral sides LS, RS of the stack 18. The contacting surfaces 60*a*, 62*a* are made of suitably chosen materials and of suitably chosen dimensions, so as to be effective at preventing sliding motion—in the dispensing direction DD (FIGS. 4 and 5)—of the napkins 12 engaged by those surfaces. For example, the contacting surfaces 60*a*, 62*a* may both include a rigid plastic material, may have a depth of about 1 mm, and a height of about 5 mm. A relatively small size of the contacting surfaces 60*a*, 62*a* may be desirable to attain relatively large forces exerted by those surfaces 60*a*, 62*a* on the lateral sides LS, RS of stack 18. But, depending on the material chosen for the restrictors 60, 62, a small size of the contacting surfaces 60*a*, 62*a* may also increase the likelihood of the components containing those surfaces wearing off or even breaking, thereby requiring replacement for continuing efficient operation of the dispenser 10.

Figure 15:
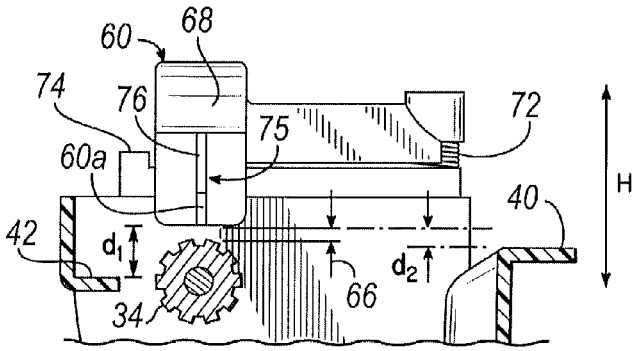
FIG. 15 is a partial elevation view of a portion of the dispenser of FIG. 1, illustrating a position of the restrictor of FIG. 12 relative to other features.
Figure 16:
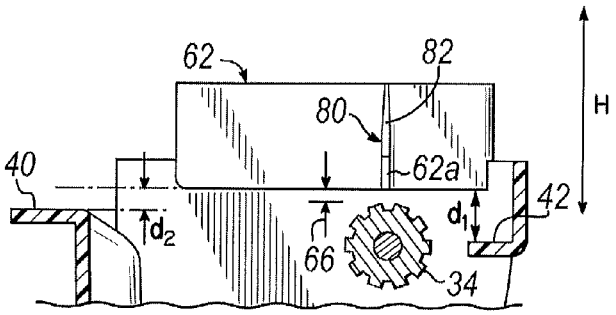
FIG. 16 is a partial elevation view of another portion of the dispenser of FIG. 1, illustrating a position of the restrictor of FIG. 14 relative to other features.

FIGS. 15 and 16, in particular, illustrate the respective bottommost edges of the contacting surfaces 60*a*, 62*a* being spaced, in the height dimension H of housing 14, from the uppermost surface of roller 34. That spacing between the contacting surfaces 60*a*, 62*a* and the roller 34 thereby defines a gap 66 which, in particular embodiments, may correspond to the approximate thickness of one or two napkins 12. For example, and without limitation, the size of the gap 66 may be between about 1 mm and about 4 mm, and more specifically between about 1 mm and about 3 mm in specific embodiments. It is also contemplated that the contacting surfaces 60*a*, 62*a* may alternatively be spaced, in the height dimension H of housing 14, from the uppermost surface of roller 34, by two different distances. It is further contemplated that only one of the two contacting surfaces 60*a*, 62*a* may be spaced in the height dimension H from the uppermost surface of roller 34.

In the illustrated embodiment also, the relatively low respective positions of the back and front support ledges 40, 42 are such that the contacting surfaces 60*a*, 62*a* are spaced from the napkin-contacting surfaces of the support ledges 40, 42 in the height dimension H, by respective distances that are larger than the gap 66 described above. For example, and without limitation, the napkin-contacting surface of front support ledge 42 may be spaced from the contacting surfaces 60*a*, 62*a*, in the height dimension H, by a distance $d_1$ of about 8 mm to about 12 mm. Likewise, the napkin-contacting surface of back support ledge 40 may be spaced from the contacting surfaces 60*a*, 62*a*, in the height dimension H, by a distance $d_2$ of about 5 mm to about 9 mm.

In the exemplifying embodiments of FIGS. 4-16, the contacting surfaces 60*a*, 62*a* do not make engaging contact with napkins 12 in the gap 66, and those napkins are therefore free from the lateral forces exerted upon the lateral sides LS, RS of stack 18. This freedom from the lateral forces otherwise exerted on lateral sides LS, RS allows the napkins 12 in the gap 66 to be dispensed when roller 34 rotates, in the manner discussed above. In the illustrated embodiments, the dimension of gap 66 corresponds to the approximate thickness of two interleaved napkins 12, such that rotation of the roller 34 by a first amount (FIGS. 8 and 9) is effective to dispense only the bottommost napkin 12*a*, as well as the oppositely folded napkin adjacent napkin 12*a*. It is contemplated, however, that the gap 66 could alternatively have a dimension corresponding to the thickness of a single napkin 12*a* not interleaved with others, or a dimension corresponding to the thickness of any desired number of napkins 12 at the bottom end of the stack 18, whether or not interleaved.

With continued reference to FIGS. 4-16, and referring particularly to FIGS. 4, 5, 7, 10-13, and 15, the first restrictor 60 includes a movable main body 68 that is urged inwardly i.e., toward stack 18, by a suitably positioned biasing element such as, and without limitation, a spring, elastic band, bellows or a resilient component (e.g., foam or rubber ball or block). In the illustrated embodiment, the main body 68 is pivotally mounted to housing 14 at a distal pivoting location 70, and the biasing element takes the form of a torsion spring 72 that is located at the pivoting location 70. The torsion spring 72 urges the main body 68 inwardly i.e., toward the left side LS of stack 18, to thereby exert a force against the left side LS of stack 18 in a first direction LD (FIGS. 5, 12, and 13) that is transverse to the dispensing dimension DD and also to the stacking dimension SD. In one aspect of the illustrated embodiment, the urging of main body 68 by spring 72 allows the main body 68 to automatically self-adjust so as to make engaging contact with the left side LS of stack 18, irrespective of any variability in width of stack 18. This may be desirable in order for dispenser 10 to be able to dispense napkins 12 from stacks 18 having conventional manufacturing variability, as well as from stacks 18 of napkins of different type.

The range of inward motion of the main body 68 is limited, in the embodiments of FIGS. 4-16, by contacting engagement of an extension 73 of main body 68 with a cooperating stopping plate 74 (FIG. 4) in housing 14. In one aspect, limiting the range of inward motion of main body 68 provides more control over the magnitude of lateral forces that may be exerted by main body 68 on the left side LS of the stack 18, and also prevents the main body 68 from interfering with the loading of napkins 12 into housing 14. In another aspect, however, limiting the range of inward motion of main body 68 may prevent the exertion of lateral forces, by main body 68, on the side LS of very narrow stacks 18. The contacting surface 60*a* of first restrictor 60 is located on a rib 75 forming part of the main body 68. Those of ordinary skill in the art will readily appreciate, however, that the contacting surface 60*a* may take other alternative forms and may even include a plurality of surfaces, rather than a single surface. In that embodiment, the rib 75 also includes a guiding surface 76 contiguous with and angled (e.g., defining an obtuse angle) with respect to the contacting surface 60*a*, the function of which is explained more fully below.

Figure 5:
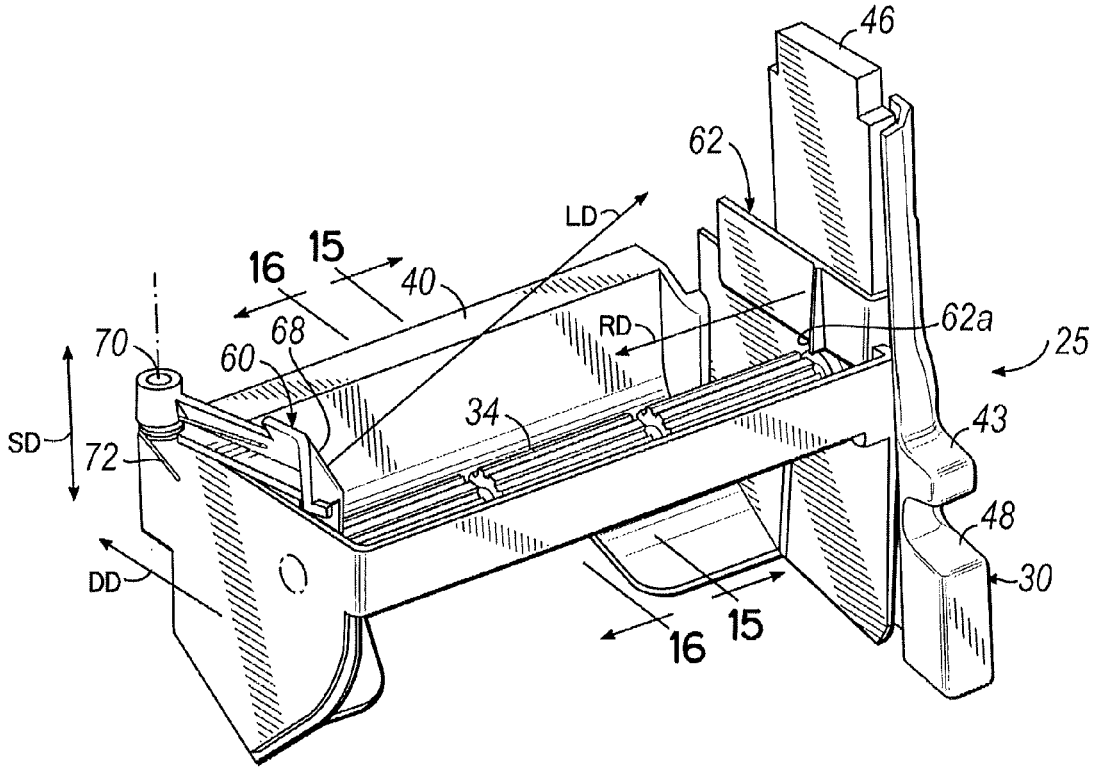
FIG. 5 is another perspective view of the portion of the dispenser shown in FIG. 4.
Figure 12:
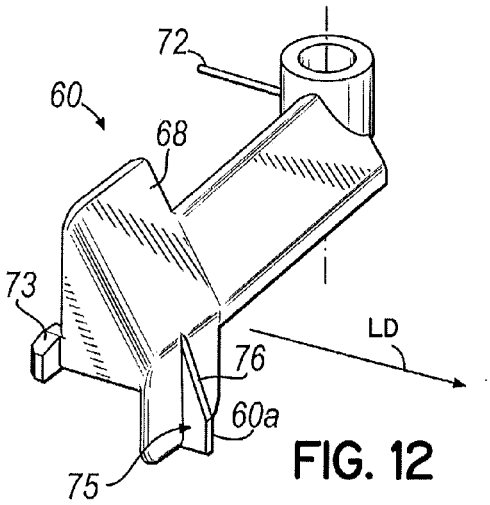
FIG. 12 is a perspective view of a restrictor of the dispenser of FIG. 1, in accordance with one embodiment of the invention.
Figure 13:
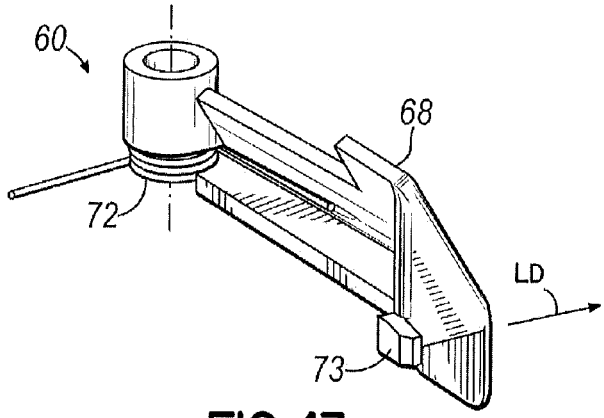
FIG. 13 is another perspective view of the restrictor shown in FIG. 12.
Figure 14:
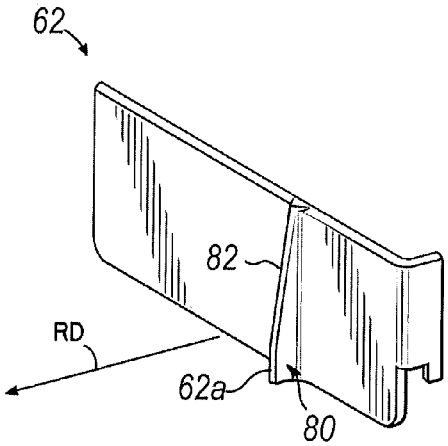
FIG. 14 is a perspective view of another restrictor of the dispenser of FIG. 1, in accordance with one embodiment of the invention.

Referring particularly to FIGS. 5, 7, 10, 11, 14, and 16, the second restrictor 62 of the illustrative embodiment in those figures, by contrast, is a non-movable structure that is coupled to housing 14 at a location adjacent the right side RS of stack 18. The contacting surface 62*a* of second restrictor 62 is located on a rib 80 that is similar to the rib 75 of first restrictor 60 (FIGS. 12 and 15). Similarly to the rib 75 of the first restrictor 60, the rib 80 of second restrictor 62 also has a guiding surface 82. Guiding surface 82 is contiguous with and angled (e.g., defining an obtuse angle) with respect to the contacting surface 62*a* of the second restrictor 62, as shown in FIGS. 10, 11, and 14, for example. Those of ordinary skill in the art will readily appreciate that the contacting surface 62*a* may take other alternative forms and may even include a plurality of surfaces, rather than a single surface. The contacting surface 62*a* of second restrictor 62 engages the right side RS of stack 18 and exerts an inward, lateral force against the right side RS, in a direction RD (FIGS. 5 and 14) that is transverse to the dispensing direction DD, and also to the stacking dimension SD (FIG. 5). In specific embodiments, the inward forces exerted on the lateral sides LS, RS of the stack 18 are in directions that are generally opposite one another and, depending on the type of stack 18 loaded into dispenser 18, may have a magnitude sufficient to cause the engaged napkins 12 to buckle, as seen in FIG. 10, for example.

In another aspect of the embodiments illustrated in FIGS. 4-16, the spacing between the first and second restrictors 60, 62 and, particularly, between the respective contacting surfaces 60*a*, 62*a*, is suitably chosen such that minimum desired magnitudes of inwardly directed, lateral forces are exerted upon the sides LS, RS of stack 18, even for relatively narrow stacks 18. Minimum desired magnitudes of lateral forces are attained when those forces are effective to prevent unintended dispensing of napkins 12 located above the gap 66 (FIGS. 15 and 16), upon rotation of roller 34.

In use, the angled guiding surfaces 76, 82 gradually guide the stack 18 toward the contacting surfaces 60*a*, 62*a* to thereby provide a smooth transition between portions of stack 18 that are free of inwardly directed lateral forces, and portions of the stack 18 that receive inwardly directed lateral forces exerted by the contacting surfaces 60*a*, 62*a*. A smooth transition may be effective to minimize the likelihood of jams and may therefore facilitate flawless, continuing operation of the dispenser shown in those figures. While the embodiments of FIGS. 4-16 include a pair of guiding surfaces 76, 82, alternative embodiments are contemplated having guiding surfaces in a different number, having different shapes, and/or located in other structures adjacent the contacting surfaces 60*a*, 62*a* or not. Similarly, alternative embodiments are contemplated having no guiding surfaces at all, with those alternative embodiments being less complex and therefore easier to manufacture than embodiments having guiding surfaces.

Either of the first or second restrictors 60, 62 may take other forms, different from those shown in FIGS. 4, 5, 7, and 10-16. For example, and without limitation, one or both of the first and second restrictors 60, 62 may include a plurality of bendable bristles that are able to flex to accommodate stacks of different width, and which make engaging contact with the sides LS, RS of stack 18. In those contemplated embodiments, bristles would be chosen having a suitable level of rigidity. More specifically, the bristles would be sufficiently rigid so as to exert lateral forces against the sides LS, RS, effective to prevent unintended dispensing of napkins 12 engaged by the bristles when roller 34 rotates.

Figure 17:
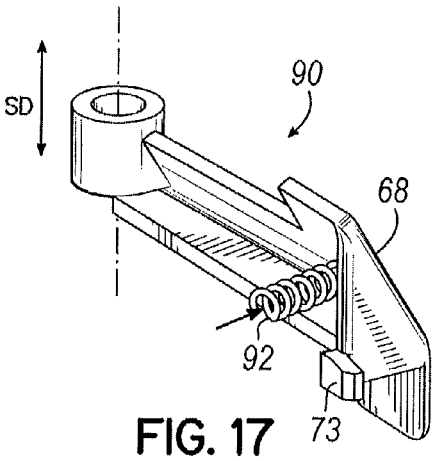
FIG. 17 is a perspective view of a restrictor, in accordance with another embodiment of the invention.
Figure 18:
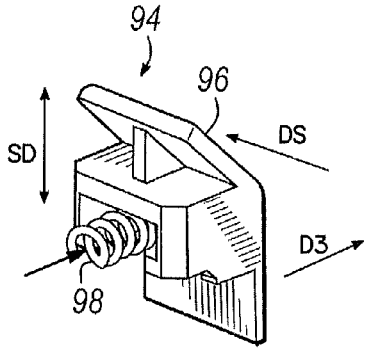
FIG. 18 is a perspective view of a restrictor, in accordance with yet another embodiment of the invention.

FIGS. 17 and 18 illustrate alternative embodiments of restrictors similar to the first restrictor 60 in FIGS. 4, 5, 7, 10-13, and 15. For ease of explanation, like reference numerals in FIGS. 17 and 18 refer to similar features in FIGS. 4, 5, 7, 10-13, and 15, the description of which may be referred to for an understanding of the features of FIGS. 17 and 18 as well. In FIG. 17, a movable restrictor 90 is illustrated, similar in most respects to the first restrictor 60 of dispenser 10, but in which the biasing element is in the form of a compression spring 92, located at the proximal end of the main body 68, rather than being a torsion spring located at the distal end of main body 68, as in the embodiments of FIGS. 4, 5, 7, 10-13, and 15. FIG. 18 shows another embodiment of a movable restrictor 94 that includes a slidable, linearly-moving main body 96, which is urged inwardly (arrow D3) by a biasing element in the form of a compression spring 98. In the embodiment of FIG. 18, the direction of the force exerted by the sliding main body 96 (arrow D3) is transverse, and specifically generally orthogonal, to the dispensing direction DS, as well as to the stacking dimension SD, as schematically represented in that figure.

While each of the dispensers in the embodiments of FIGS. 4-16 includes a pair of oppositely located restrictors, alternative embodiments are contemplated that include restrictors in any number other than two, so long as those restrictors are capable of preventing the napkins 12 engaged by those restrictors from being dispensed when roller 34 rotates. For example, and without limitation, dispensers are contemplated having only one restrictor on one side of the housing 14, capable of exerting a lateral force upon one of the sides LS, RS of stack 18, that is then opposed by a resulting opposite, normal force applied by an opposite side of the housing 14.

Figure 19:
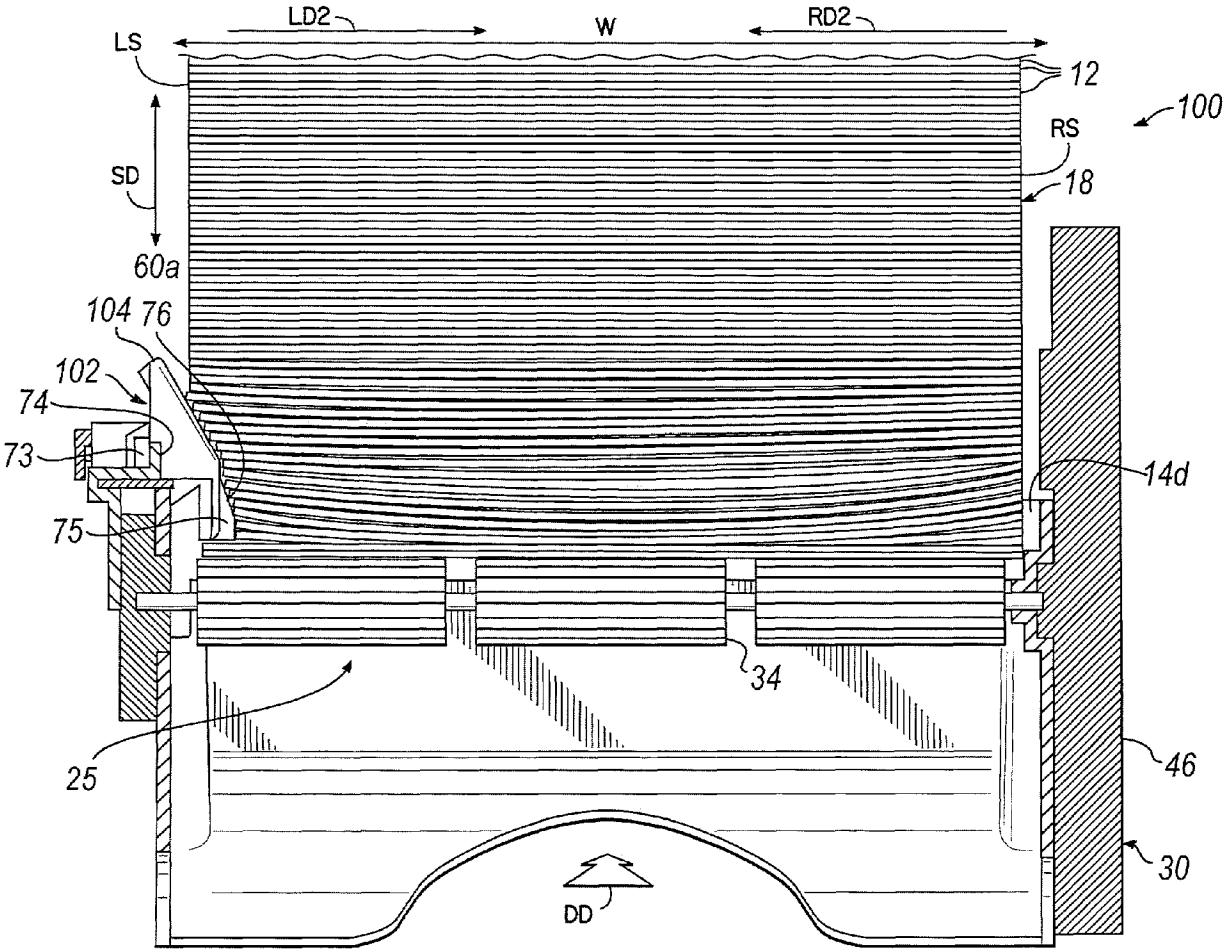
FIG. 19 is a view similar to FIGS. 7, 10, and 11, illustrating a portion of a dispenser in accordance with another embodiment of the invention.

FIG. 19 illustrates one such embodiment, in which the dispenser 100 shown in that figure has a restrictor 102 similar to any of the restrictors 60 (FIGS. 4, 5, 7, 10-13 and 15), 90 (FIG. 17), or 94 (FIG. 18) or any contemplated variations thereof. In that regard, restrictor 102 includes a spring (not shown) similar to any of the springs 72 (FIGS. 4, 5, 7, 10-13 and 15), 92 (FIG. 17), or 98 (FIG.18). The spring in the embodiment of FIG. 19 urges a movable main body 104 of restrictor 102 inwardly, toward the stack 18, which exerts a force against the left side LS of the stack 18 in a direction LD2 transverse to the dispensing direction DD (into the paper, in the view of FIG. 19) of the napkins 12, and transverse to the stacking dimension SD of napkins 12.

In response to the force exerted on stack 18 by the movable main body 104, the right sidewall 14*d* of the housing 14 applies a normal force of the same magnitude against the right side RS of stack 18, in a direction RD2 generally opposite the direction LD2, and also transverse to the dispensing direction DD and to the stacking dimension SD of napkins 12. In that embodiment, the generally opposed forces exerted by the restrictor 102 and right side wall 14*d* serve to prevent unintended dispensing of napkins 12 at the end of stack 18 when roller 34 rotates. Further, the optional guiding surface 76 of restrictor 102 serves to guide the stack downward (in the illustrative orientation shown in FIG. 19) toward the position in dispenser 100 at which forces are exerted on stack 18, in the manner described above.

While not shown, embodiments are contemplated in which a dispenser has not one, but two movable restrictors, opposite one another, and both urged inwardly by respective biasing elements such as, and without limitation, springs, elastic bands, bellows or resilient components (e.g., foam or rubber balls or blocks). For example, each of the two movable restrictors could take the form of any of the restrictors 60, 90, or 94 in FIGS. 4, 17, and 18 respectively. Likewise, dispensers are contemplated having a pair of oppositely disposed non-movable restrictors, similar for example to the restrictor 62 in FIGS. 5, 14, and 16. In contemplated embodiments of upright-oriented dispensers (e.g., dispenser 10 in FIG. 1) having two opposed non-movable restrictors, gravity, and more specifically the weight of the stack 18, may suffice to direct the stack 18 between the force-exerting, contacting surfaces of those non-movable restrictors. Alternatively, a weight (for upright-oriented dispensers), a pressure plate, or some other device may be used to push the stack 18 toward the force-exerting, contacting surfaces of the non-movable restrictors. All of these alternative embodiments are considered to be within the scope of the present disclosure.

Exemplifying embodiments of the invention are described as follows, in non-limiting fashion:

1. An apparatus for dispensing paper product from a stack of paper product stacked along a stacking dimension, comprising:
   a housing for holding the stack of paper product and having a longitudinal dimension associated with the stacking dimension;
   a movable ejector located adjacent said housing and configured to contact paper product at and end of the stack, movement of said ejector being effective to slide paper product at the end of the stack, relative to a remainder of the stack, in a dispensing direction, to thereby dispense paper product from said housing; and
   a first restrictor in said housing configured to exert a force on the stack in a first restricting direction transverse to the dispensing direction, said first restrictor being spaced from said ejector in the longitudinal dimension by a first distance.
2. The apparatus of clause 1, wherein the first restricting direction is generally orthogonal to the dispensing direction.
3. The apparatus of either of clauses 1 or 2, further comprising:
   a second restrictor in said housing configured to exert a force on the stack in a second restricting direction generally opposite the first restricting direction and transverse to the dispensing direction.
4. The apparatus of clause 3, wherein:
   said first restrictor includes a movable main body for making engaging contact with the stack, and a biasing element configured to urge said main body toward the stack, and
   said second restrictor is non-movable.
5. The apparatus of clause 4, wherein at least one of said first restrictor or said second restrictor has a force-exerting contacting surface for exerting force on the stack, and an adjacent guiding surface for guiding paper product in the stack toward said force-exerting contacting surface.
6. The apparatus of clause 5, wherein said force-exerting contacting surface and said guiding surface are contiguous.
7. The apparatus of either of clauses 5 or 6, wherein said guiding surface is oriented at an angle relative to said force-exerting contacting surface.
8. The apparatus of any of clauses 1-7, wherein said first restrictor includes a movable main body for making engaging contact with the stack, and a biasing element, said biasing element being configured to urge said movable main body toward the stack.
9. The apparatus of clause 8, wherein said movable main body is pivotally mounted to said housing at a pivoting location.
10. The apparatus of clause 9, wherein said biasing element is a torsion spring located at said pivoting location.
11. The apparatus of any of clauses 1-10, further comprising:
    a stand coupled to said housing and having a surface for resting the apparatus on a horizontal surface so as to define a top end and a bottom end of said housing, said ejector being located adjacent said bottom end and being configured to at least partially support a weight of the stack when the apparatus is resting on a horizontal surface.
12. The apparatus of any of clauses 1-11, wherein said ejector includes a roller, and movement of said ejector includes rotation of said roller.
13. The apparatus of any of clauses 1-11, further comprising:
    an actuator operatively coupled to said ejector and configured to move said ejector for sliding paper product at the end of the stack relative to a remainder of the stack.
14. The apparatus of clause 13, wherein said actuator includes an electric motor operatively coupled to said ejector.
15. The apparatus of either of clauses 13 or 14, wherein said actuator has a plurality of available cycles of said ejector, each associated with a different number of paper product to be dispensed from the stack by the apparatus.
16. The apparatus of any of clauses 1-15, wherein an interior of said housing has a generally rectangular cross-section defining a width dimension and a depth dimension thereof, said dispensing direction being generally parallel to said depth dimension and said first restricting direction being generally parallel to said width dimension.

17. The apparatus of any of clauses 1-16, wherein said housing includes at least one support ledge having a ledge surface for contacting and supporting a weight of the stack, said ledge surface being spaced from said first restrictor, in the longitudinal dimension, by a second distance greater than the first distance.

18. The apparatus of any of clauses 1-17, wherein said ejector is positioned relative to said housing so as to at least partially support a weight of the stack.

19. A method of dispensing paper product from a stack thereof, the paper product being stacked along a stacking dimension, the method comprising:

supporting the stack within a dispenser;

exerting forces on a portion of the stack adjacent an end of the stack, the forces being exerted in respective first and second restricting directions;

maintaining paper product at the end of the stack free of the forces exerted in the first and second restricting directions; and sliding the paper product at the end of the stack, relative to a remainder of the stack, in a dispensing direction transverse to the first and second restricting directions.

20. The method of clause 19, wherein sliding the paper product at the end of the stack includes sliding the paper product at the end of the stack in a dispensing direction that is generally orthogonal to at least one of the first or second restricting directions.

21. The method of either of clauses 19 or 20, further comprising:

engaging at least one of opposed first and second sides of the stack so as to guide the stack toward a location of the dispenser at which forces are exerted in the first and second restricting directions.

22. The method of any of clauses 19-21, wherein exerting forces in the first and second restricting directions includes urging at least one movable contacting surface toward a side of the stack.

23. The method of any of clauses 19-22, wherein exerting forces in the first and second restricting directions includes buckling a portion of the stack.

24. The method of any of clauses 19-23, wherein sliding the paper product at the end of the stack includes imparting rotational motion upon the paper product at the end of the stack.

25. The method of any of clauses 19-24, further comprising:

rotating a roller by an amount of rotation sufficient to engage and slide at least two successive paper products at the end of the stack relative to a remainder of the stack, to thereby dispense the at least two successive paper products from within the dispenser.

26. An apparatus for dispensing paper product from a stack of paper product stacked along a stacking dimension, comprising:

means for holding the stack of paper product, said means having a longitudinal dimension associated with the stacking dimension;

movable means located adjacent said means for holding the stack of paper product, said movable means being configured to contact paper product at and end of the stack, movement of said movable means being effective to slide paper product at the end of the stack, relative to a remainder of the stack, in a dispensing direction, to thereby dispense paper product from said means for holding the stack of paper product; and first means for exerting a force on the stack in a first restricting direction transverse to the dispensing direction, said first means for exerting a force being spaced from said movable means in the longitudinal dimension by a first distance.

27. The apparatus of clause 26, wherein the first restricting direction is generally orthogonal to the dispensing direction.

28. The apparatus of either of clauses 26 or 27, further comprising:

second means for exerting a force on the stack in a second restricting direction generally opposite the first restricting direction and transverse to the dispensing direction.

29. The apparatus of clause 28, wherein:

said first means for exerting a force includes a movable main body for making engaging contact with the stack, and biasing means configured to urge said main body toward the stack, and said second means for exerting a force is non-movable.

30. The apparatus of clause 29, wherein at least one of said first or second means for exerting a force includes adjacent guiding means for guiding paper product in the stack toward a location at which force is exerted on the stack.

31. The apparatus of clause 30, wherein said at least one of said first or second means for exerting a force includes a force-exerting contacting surface, and said guiding means includes a guiding surface, said force-exerting contacting surface being contiguous with said guiding surface.

32. The apparatus of either of clauses 31, wherein said guiding surface is oriented at an angle relative to said force-exerting contacting surface.

33. The apparatus of any of clauses 26-32, wherein said first means for exerting a force includes a movable body for making engaging contact with the stack, and a biasing means, said biasing means being configured to urge said movable body toward the stack.

34. The apparatus of clause 33, wherein said movable body is pivotally mounted to said means for holding the stack of paper product at a pivoting location.

35. The apparatus of clause 34, wherein said biasing means is a torsion spring located at said pivoting location.

36. The apparatus of any of clauses 26-35, further comprising:

orientation means coupled to said means for holding the stack of paper product and configured to secure the apparatus in an upright orientation, so as to define a top end and a bottom end of said means for holding the stack of paper product, said movable means being located adjacent said bottom end and being configured to at least partially support a weight of the stack when the apparatus is in the upright orientation.

37. The apparatus of any of clauses 26-36, wherein said movable means includes a roller, and movement of said movable means includes rotation of said roller.

38. The apparatus of any of clauses 26-37, further comprising:

actuating means operatively coupled to said movable means for moving said movable means to thereby slide paper product at the end of the stack relative to a remainder of the stack.

39. The apparatus of clause 38, wherein said actuating means includes an electric motor operatively coupled to said movable means.

40. The apparatus of either of clauses 38 or 39, wherein said actuating means has a plurality of available cycles of said movable means, each associated with a different number of paper products to be dispensed from the stack by the apparatus.

41. The apparatus of any of clauses 26-40, wherein an interior of said means for holding the stack of paper product has a generally rectangular cross-section defining a width dimension and a depth dimension thereof, said dispensing direction being generally parallel to said depth dimension and said first restricting direction being generally parallel to said width dimension.

42. The apparatus of any of clauses 26-41, wherein said means for holding the stack of paper product includes supporting means for contacting and supporting a weight of the stack, said supporting means being spaced from said first means for exerting a force, in the longitudinal dimension, by a second distance greater than the first distance.

43. The apparatus of any of clauses 26-42, wherein said movable means is positioned relative to said means for holding the stack of paper product so as to at least partially support a weight of the stack.

Yet other embodiments are also contemplated for uses of systems, apparatus and/or components according to any of clauses 1 to 18 or 26 to 43, as described above or in any way implementing the methods of any of clauses 26 to 43, as described above.

From the above disclosure of the general principles of the present invention and the preceding detailed description of exemplifying embodiments, those skilled in the art will readily comprehend the various modifications to which this invention is susceptible. Accordingly, this invention is intended to be limited only by the scope of the following claims and equivalents thereof.

What is claimed is:

1. An apparatus configured to dispense paper product from an end of a stack of paper product stacked along a stacking dimension defining a thickness of the stack, each paper product having a plurality of side edges orthogonal to the stacking dimension of the stack, the apparatus comprising:

a housing configured to encompass the stack of paper product, the housing being arranged within the apparatus and having a longitudinal dimension generally parallel to the stacking dimension, the housing configured to support the end of the stack at an end position of the housing;

a movable ejector located adjacent said housing and having a contacting surface configured to contact the paper product at the end of the stack, movement of said ejector being effective to slide the paper product at the end of the stack, relative to a remainder of the stack, in a dispensing direction, to thereby dispense paper product from said housing;

a first restrictor in said housing having a first force-exerting contacting surface configured to exert a first force on a portion of the stack that is spaced from the end position in a first restricting direction transverse to the dispensing direction, said first restrictor being spaced from said end position in the longitudinal dimension by a first distance such that no force is exerted on the stack in the first restricting direction between the first restrictor and the elector; and a second restrictor in said housing having a second force-exerting contacting surface configured to exert a second force on the same portion of the stack on which the first force-exerting contacting surface is configured to exert the first force, the second force being oriented in a second restricting direction generally opposite the first restricting direction and transverse to the dispensing direction, the second restrictor being spaced from the end position such that no force is exerted on the stack in the second restricting direction between the second restrictor and the elector.

2. The apparatus of claim 1, wherein the first restricting direction is generally orthogonal to the dispensing direction.

3. The apparatus of claim 1, wherein:

said first restrictor includes a movable main body for making engaging contact with the stack, and a biasing element configured to urge said main body toward the stack, and said second restrictor is non-movable.

4. The apparatus of claim 3, wherein at least one of said first restrictor and said second restrictor has a guiding surface adjacent said first force-exerting contacting surface or said second force-exerting contacting surface, said guiding surface being configured to guide paper product in the stack toward said adjacent first or second force-exerting contacting surface.

5. The apparatus of claim 4, wherein said first or second force-exerting contacting surface and said adjacent guiding surface are contiguous.

6. The apparatus of claim 4, wherein said guiding surface is oriented at an angle relative to said first or second force-exerting contacting surface adjacent thereto.

7. The apparatus of claim 1, wherein said first restrictor includes a movable main body for making engaging contact with the stack, and a biasing element, said biasing element being configured to urge said movable main body toward the stack.

8. The apparatus of claim 7, wherein said movable main body is pivotally mounted to said housing at a pivoting location.

9. The apparatus of claim 8, wherein said biasing element is a torsion spring located at said pivoting location.

10. The apparatus of claim 1, further comprising:

a stand coupled to said housing and having a surface for resting the apparatus on a horizontal surface so as to define a top end and a bottom end of said housing, said ejector being located adjacent said bottom end and being configured to at least partially support a weight of the stack when the apparatus is resting on a horizontal surface.

11. The apparatus of claim 1, wherein said first restrictor is arranged opposite said second restrictor along the stacking dimension.

12. The apparatus of claim 1, wherein said ejector includes a roller, and movement of said ejector includes rotation of said roller.

13. The apparatus of claim 1, further comprising:

an actuator operatively coupled to said ejector and configured to move said ejector for sliding paper product at the end of the stack relative to a remainder of the stack.

14. The apparatus of claim 13, wherein said actuator includes an electric motor operatively coupled to said ejector.

15. The apparatus of claim 13, wherein said actuator has a plurality of available cycles of said ejector, each associated with a different number of paper products to be dispensed from the stack by the apparatus.

16. The apparatus of claim 1, wherein an interior of said housing has a generally rectangular cross-section defining a width dimension and a depth dimension thereof, said dispensing direction being generally parallel to said depth dimension and said first restricting direction being generally parallel to said width dimension.

17. The apparatus of claim 1, wherein said housing includes at least one support ledge having a ledge surface for contacting and supporting a weight of the stack, said ledge surface being spaced from said first force-exerting contacting surface, in the longitudinal dimension, by a second distance greater than the first distance.

18. The apparatus of claim 1, wherein said ejector is positioned relative to said housing so as to at least partially support a weight of the stack.

19. An apparatus configured to dispense paper product from an end of a stack of paper product stacked along a stacking dimension defining a thickness of the stack, each Paper product having a plurality of side edges orthogonal to the stacking dimension of the stack, the apparatus comprising:

a housing configured to encompass the stack of paper product, the housing being arranged within the apparatus and having a longitudinal dimension generally parallel to the stacking dimension, the housing configured to support the end of the stack at an end position of the housing;

a roller located adjacent said housing and having a contacting surface configured to contact the paper product at the end of the stack, and to at least partially support a weight of the stack, rotation of said roller being effective to slide the paper product at the end of the stack, relative to a remainder of the stack, in a dispensing direction, to thereby dispense paper product from said housing;

a movable restrictor in said housing having a first force-exerting contacting surface configured to exert a force on the stack in a first restricting direction transverse to the dispensing direction, said movable restrictor having a pivotable main body and a biasing element configured to urge said pivotable main body toward the stack; and a non-movable restrictor in said housing having a second force-exerting contacting surface configured to exert a force on the stack in a second restricting direction generally opposite the first restricting direction and transverse to the dispensing direction, wherein the end position of the housing is spaced from said first and second force-exerting contacting surfaces in the longitudinal dimension such that no force is exerted on the stack in the first restricting direction between the movable restrictor and the roller, and no force is exerted on the stack in the second restricting direction between the non-movable restrictor and the roller.

20. The apparatus of claim 19, further comprising:

an actuator operatively coupled to said roller and configured to rotate said roller for sliding paper product at the end of the stack relative to a remainder of the stack.

21. The apparatus of claim 19, wherein said movable restrictor is arranged opposite said non-movable restrictor along the stacking dimension.

22. A method of dispensing paper product from a stack thereof, the paper product being stacked along a stacking dimension defining a thickness of the stack, each paper product having a plurality of side edges orthogonal to the stacking dimension of the stack, the method comprising:

supporting the stack within a dispenser;

exerting a first force on a portion of the stack spaced, along the stacking dimension, from a longitudinal end of the stack;

exerting a second force on the same portion of the stack on which the first force is exerted, the first and second forces being exerted in respective first and second restricting directions generally opposite one another;

maintaining paper product at the longitudinal end of the stack free of the first and second forces exerted respectively in the first and second restricting directions; and sliding the paper product at the longitudinal end of the stack, relative to a remainder of the stack, in a dispensing direction transverse to the first and second restricting directions.

23. The method of claim 22, wherein sliding the paper product at the longitudinal end of the stack includes sliding the paper product at the longitudinal end of the stack in a dispensing direction that is generally orthogonal to at least one of the first or second restricting directions.

24. The method of claim 22, further comprising:

engaging at least one of opposed first and second sides of the stack so as to guide the stack toward a location of the dispenser at which forces are exerted in the first and second restricting directions.

25. The method of claim 22, wherein exerting the first and second forces respectively in the first and second restricting directions includes urging at least one movable contacting surface toward a side of the stack.

26. The method of claim 22, wherein exerting the first and second forces respectively in the first and second restricting directions includes buckling a portion of the stack.

27. The method of claim 22, wherein sliding the paper product at the end of the stack includes imparting rotational motion upon the paper product at the longitudinal end of the stack.

28. The method of claim 22, further comprising:

rotating a roller by an amount of rotation sufficient to engage and slide at least two successive paper products at the longitudinal end of the stack relative to a remainder of the stack, to thereby dispense the at least two successive paper products from within the dispenser.

29. The method of claim 22, wherein the first force is directed opposite the first force in the stacking dimension.

30. The method of claim 22, wherein the dispensing direction is transverse to the stacking dimension.

* * * * *